US009415439B2

(12) United States Patent
Fenton et al.

(10) Patent No.: US 9,415,439 B2
(45) Date of Patent: Aug. 16, 2016

(54) IN-SITU HOMOGENIZATION OF DC CAST METALS WITH ADDITIONAL QUENCH

(71) Applicant: NOVELIS INC., Atlanta, GA (US)

(72) Inventors: Wayne J. Fenton, Spokane Valley, WA (US); Jeff McDermott, Liberty Lake, WA (US); Robert Bruce Wagstaff, Greenacres, WA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 14/333,314

(22) Filed: Jul. 16, 2014

(65) Prior Publication Data

US 2014/0326426 A1 Nov. 6, 2014

Related U.S. Application Data

(62) Division of application No. 13/765,490, filed on Feb. 12, 2013, now Pat. No. 8,813,827.

(60) Provisional application No. 61/614,790, filed on Mar. 23, 2012.

(51) Int. Cl.
*B22D 11/124* (2006.01)
*B22D 7/00* (2006.01)
(Continued)

(52) U.S. Cl.
CPC ..... *B22D 11/1246* (2013.01); *B22D 7/005* (2013.01); *B22D 11/003* (2013.01); *B22D 11/049* (2013.01); *B22D 11/1248* (2013.01); *B22D 30/00* (2013.01)

(58) Field of Classification Search
CPC ..... B22D 11/124; B22D 11/1246; B22D 11/1248
USPC ..... 164/444, 486, 487
See application file for complete search history.

(56) References Cited

U.S. PATENT DOCUMENTS 2,301,027 A 11/1942 Ennor
2,651,821 A 9/1953 Chadwick et al.
(Continued)

FOREIGN PATENT DOCUMENTS

CN 101300092 A 11/2008
EP 0095151 A1 11/1983
(Continued)

OTHER PUBLICATIONS

Canadian Patent Application No. 2,864,226, Office Action mailed Oct. 31, 2014, 4 pages.
(Continued)

*Primary Examiner* — Kevin P Kerns
(74) *Attorney, Agent, or Firm* — Kilpatrick Townsend & Stockton LLP

(57) ABSTRACT

The invention relates to a method and apparatus for direct chill casting ingots with in-situ homogenization. Large particles of eutectic material may form in the solid ingot and the metal may exhibit macrosegregation of alloying components, especially when large ingots are cast in this way. This can be alleviated by applying a first liquid coolant to the ingot emerging from the mold, removing the first liquid coolant at a certain distance along the ingot by means of a wiper, and then applying a second liquid coolant to perform a quench at a greater distance along the ingot. The quench raises the level of the molten sump in the ingot, which helps to overcome the indicated problems, without affecting the desired temperature rebound of the ingot shell (usually at least 425° C. (797° F.)) for a time effective to cause in-situ homogenization.

22 Claims, 16 Drawing Sheets

(51) Int. Cl.

| | |
|---|---|
| ***B22D 11/00*** | (2006.01) |
| ***B22D 11/049*** | (2006.01) |
| ***B22D 30/00*** | (2006.01) |

(56) References Cited

U.S. PATENT DOCUMENTS

| | | | | |
|---|---|---|---|---|
| 2,871,529 | A | 2/1959 | Kilpatrick | |
| 3,713,479 | A * | 1/1973 | Bryson | 164/487 |
| 3,763,921 | A | 10/1973 | Behr et al. | |
| 3,985,179 | A | 10/1976 | Goodrich et al. | |
| 4,004,631 | A | 1/1977 | Goodrich et al. | |
| 4,474,225 | A | 10/1984 | Yu | |
| 4,993,476 | A * | 2/1991 | Nagai et al. | 164/440 |
| 5,431,214 | A | 7/1995 | Ohatake et al. | |
| 5,452,756 | A | 9/1995 | Ohatake et al. | |
| 6,546,995 | B1 | 4/2003 | Wagstaff | |
| 7,007,739 | B2 | 3/2006 | Shaber | |
| 7,516,775 | B2 | 4/2009 | Wagstaff et al. | |
| 8,813,827 | B2 * | 8/2014 | Fenton et al. | 164/487 |
| 2009/0301683 | A1 | 12/2009 | Reeves et al. | |

FOREIGN PATENT DOCUMENTS

| | | |
|---|---|---|
| FR | 2233123 A1 | 1/1975 |
| JP | 6250059 | 3/1987 |
| JP | 62238051 | 10/1987 |
| JP | 05318031 | 12/1993 |
| JP | 2000005852 | 1/2000 |
| KR | 20080065288 | 7/2008 |
| WO | 2013138924 | 9/2013 |

OTHER PUBLICATIONS

El-Bealy, "Interdendritic Strain and Macrosegregation-Coupled Phenomena for Interdendritic Crack Formation in Direct-Chill Cast Sheet Ingots," Metallurgical and Materials Transactions B, vol. 43, No. 3, Jun. 2012, 2 pages.

International Patent Application No. PCT/US2013/050193, International Search Report and Written Opinion mailed Apr. 28, 2013, 11 pages.

U.S. Appl. No. 13/765,490, Notice of Allowance mailed Apr. 25, 2014, 11 pages.

Canadian Patent Application No. 2,864,226, Office Action mailed Feb. 19, 2015, 5 pages.

EP 13763981.1, "Extended European Search Report" mailed Nov. 20, 2015, 6 pages.

Canadian Patent Application No. 2,864,226, Office Action mailed Sep. 18, 2015, 5 pages.

Chinese Patent Application No. 201380015555.7, Office Action mailed Aug. 24, 2015.

Korean Application No. 10-2014-7029318, Office Action mailed on Dec. 29, 2015, with English translation, 11 pages.

Canadian Application No. 2,864,226, Office Action mailed on Jan. 11, 2016, 3 pages.

* cited by examiner

Sample 1 CQ: 250X

Sample 2 CQ: 250X

Sample 6 CQ: 250x

Sample 1 QQ: 250X

Sample 2 QQ: 250X

Sample 6 QQ: 250X

IN-SITU HOMOGENIZATION OF DC CAST METALS WITH ADDITIONAL QUENCH

CROSS REFERENCE TO RELATED APPLICATION

This application claims priority to U.S. patent application Ser. No. 13/765,490 filed Feb. 12, 2013, now issued as U.S. Pat. No. 8,813,827, which claims priority to U.S. provisional patent application Ser. No. 61/614,790 filed Mar. 23, 2012, the entire contents of both of which are incorporated herein by reference.

BACKGROUND OF THE INVENTION

I. Field of the Invention

This invention relates to the casting of molten metals, particularly molten metal alloys, by direct chill casting and the like. More particularly, the invention relates to such casting involving in-situ homogenization.

II. Background Art

Metal alloys, and particularly aluminum alloys, are often cast from molten form to produce ingots or billets that are subsequently subjected to rolling, hot working, and/or other treatments, to produce sheet or plate articles used for the manufacture of numerous products. Ingots are frequently produced by direct chill (DC) casting, but there are equivalent casting methods, such as electromagnetic casting (e.g. as typified by U.S. Pat. Nos. 3,985,179 and 4,004,631, both to Goodrich et al.), that are also employed. The term "direct chill" refers to the application of a coolant liquid directly onto a surface of an ingot or billet as it is being cast. The following discussion relates primarily to DC casting, but the same principles apply all such casting procedures that create the same or equivalent microstructural properties in the cast metal.

DC casting of metals (e.g. aluminum and aluminum alloys—referred to collectively in the following as aluminum) to produce ingots is typically carried out in a shallow, open-ended, axially vertical mold having a mold wall (casting surface) encircling a casting cavity. The mold is initially closed at its lower end by a downwardly movable platform (often referred to as a bottom block) which remains in place until a certain amount of molten metal has built up in the mold (the so-called startup material) and has begun to cool. The bottom block is then moved downwardly at a controlled rate so that an ingot gradually emerges from the lower end of the mold. The mold wall is normally surrounded by a cooling jacket through which a cooling fluid such as water is continuously circulated to provide external chilling of the mold wall and the molten metal in contact therewith within the casting cavity. The molten aluminum (or other metal) is continuously introduced into the upper end of the chilled mold to replace the metal exiting the lower end of the mold as the bottom block descends. With an effectively continuous movement of the bottom block and correspondingly continuous supply of molten aluminum to the mold, an ingot of desired length may be produced, limited only by the space available below the mold. Further details of DC casting may be obtained from U.S. Pat. No. 2,301,027 to Ennor (the disclosure of which is incorporated herein by reference), and other patents.

While usually carried out vertically as described above, DC casting can also be carried out horizontally, i.e. with the mold oriented non-vertically and often exactly horizontally, with some modification of equipment and, in such cases, the casting operation may be essentially continuous as desired lengths can be cut from the ingot as it emerges from the mold. In the caste of horizontal DC casting, the use of an externally cooled mold wall may be dispensed with. In the following discussion, reference is made to vertical direct chill casting, but the same general concepts apply to horizontal DC casting.

The ingot emerging from the lower (or output) end of the mold in DC casting is externally solid but is still molten in its central core. In other words, the pool of molten metal within the mold extends downwardly into the central portion of a downwardly-moving ingot for some distance below the mold as a sump of molten metal within an outer solid shell. This sump has a progressively-decreasing cross-section in the downward direction as the ingot cools and solidifies inwardly from the outer surface to form a solid outer shell until the core portion becomes completely solid. The portion of the cast metal product having a solid outer shell and a molten core is referred to herein as an embryonic ingot which becomes a cast ingot when it has fully solidified throughout.

As noted above, direct chill casting is normally carried out in a mold that has actively cooled walls that initiate the cooling of the molten metal when the molten metal comes into contact with the walls. The walls are often cooled by a primary coolant (normally water) flowing through a chamber surrounding the outer surfaces of the walls. When employed, such cooling is often referred to as "primary cooling" for the metal. In such cases, the direct application of first coolant liquid (such as water) to the emerging embryonic ingot is referred to as "secondary cooling". This direct chilling of the ingot surface serves both to maintain the peripheral portion of the ingot in suitably solid state to form a confining shell, and to promote internal cooling and solidification of the ingot. The secondary cooling often provides the majority of the cooling to which the ingot is subjected.

Conventionally, a single cooling zone is provided below the mold. Typically, the cooling action in this zone is carried out by directing a substantially continuous flow of water uniformly around the periphery of the ingot immediately below the mold outlet, the water being discharged, for example, from the lower end of the cooling jacket provided for primary cooling. In this procedure, the water impinges with considerable force or momentum onto the ingot surface at a substantial angle thereto and flows downwardly over the ingot surface with continuing but diminishing cooling effect until the ingot surface temperature approximates that of the water.

U.S. Pat. No. 7,516,775 which issued on Apr. 14, 2009 to Wagstaff et al. discloses a process of molten metal casting of the above kind with an additional feature that the liquid coolant used for secondary (i.e. direct chill) cooling is removed from the exterior of the ingot at a certain distance below the mold outlet by means of a wiper, which may be an encircling solid elastomeric element through which the ingot passes or may alternatively be a wiper formed of jets of fluid (gas or liquid) directed countercurrent to the stream of secondary coolant liquid to lift the coolant streams from the ingot surface. The reason for removing the secondary coolant from the ingot surface is to allow the temperature of the outer solid shell of the embryonic ingot to rise and approach the temperature of the still-molten interior for a time sufficient to cause metallurgical changes to take place in the solid metal. These metallurgical changes are found to resemble or duplicating the changes that take place during conventional homogenization of solid castings carried out after casting and full cooling of such ingots. The rise in temperature of the shell following coolant wiping is due both to the superheat of the molten metal in the interior compare to the chilled metal of the solid outer shell, and to the latent heat that is generated as the molten metal of the interior continues to solidify over time. By this reheating effect, so-called "in-situ homogenization" is achieved, thereby avoiding the need for an additional conventional homogenization step following the casting operation. Full details of this procedure can be obtained from U.S. Pat. No. 7,516,775, the entire disclosure of which is specifically incorporated herein by this reference.

Although the in-situ homogenization procedure has proven to be most effective for its intended purpose, it has been found that certain metallurgical effects may materialize that, in some circumstances (e.g. when particularly large ingots are being cast), are undesirable. For example, as the solid shell of the ingot heats up following coolant wiping, it begins to expand at the internal interface between the solid and molten metal, thereby allowing metal of eutectic composition (the last molten metal to solidify) to pool in large pockets between previously-solidified grains or dendrites of metal of somewhat different composition present at the interface. The pooled metal of eutectic composition eventually solidifies to form large constituent particles of the metal that may be undesirably coarse for some applications. The removal of the secondary coolant by wiping also tends to change the characteristics of the molten metal sump (the central pool of molten metal in the embryonic ingot). This can lead to more severe changes in the chemistry across the ingot thickness, also called macrosegregation, than would be encountered in a standard DC ingot. If the partially solidified area between the fully liquid and fully solid regions, referred to as the semi-solid or mushy zone, becomes thicker, then solidification shrinkage induced flow will be enhanced. Solidification shrinkage induced flow occurs when the aluminum crystals (or crystals of other solvent metal) cool and begin to shrink. The shrinking crystals create a suction that pulls solute-rich liquid from high up in the mushy zone down into the small crevices at the bottom of the mushy zone. This phenomenon has the tendency to deplete the center of the ingot of solute elements while enriching the ingot or billet surface metal. Another phenomenon that affect is macrosegregation is called thermo-solutal convection; which is also enhanced by an increase in the thickness of the mushy zone. In thermo-solutal convection, liquid metal encountering the cold zone at the top of the sump near the mold wall and mold cooling sprays, becomes colder and denser. It sinks due to its increased density, and can travel through the upper part of the mushy zone, following the sump profile down and toward the center of the ingot. This phenomenon has the tendency to pull solute-rich liquid toward the ingot center, increasing the solute concentration at the ingot center and decreasing the solute at the ingot surface. A third phenomenon that affects macrosegregation is floating grains. The first crystals to solidify from an aluminum alloy are solute poor in systems with eutectic alloying elements. In the upper area of the mushy zone these crystals are loose and can be easily dislodged. If these crystals are pushed toward the bottom of the sump, as both gravity and thermo-solutal convection would be inclined to do, then the solute concentration in the ingot center will be reduced as these grains accumulate at the bottom of the sump. Again, this may be undesirable for certain applications.

U.S. Pat. No. 3,763,921 which issued to Behr et al. on Oct. 9, 1973 discloses direct chill casting of metals wherein coolant is removed from the ingot surface shortly below the mold, and reapplying the coolant to the ingot surface at a somewhat lower level. This is done to reduce ingot cracking and to permit high ingot casting speeds.

U.S. Pat. No. 5,431,214 which issued to Ohatake et al. on Jul. 11, 1995 discloses a cooling mold having first and second cooling water jackets provided inside the mold. A wiper is arranged downstream of the cooling mold to wipe off cooling water. A third cooling water jetting mouth is disposed downstream of the wiper. The disclosure focuses on smaller diameter billets.

It would be desirable to provide a modification of the in-situ homogenization process discussed above to minimize or overcome some or all of the unwanted effects when they are considered undesirable for applications for which the resulting cast ingots are intended.

SUMMARY OF THE INVENTION

According to an exemplary embodiment of the invention, there is provided a method of casting a metal ingot, comprising the steps of: (a) supplying molten metal from at least one source to a region where the molten metal is peripherally confined and forming an embryonic ingot having an external solid shell and an internal molten core; (b) advancing the embryonic ingot in a direction of advancement away from the region where the molten metal is peripherally confined while supplying additional molten metal to the region, thereby extending the molten core contained within the solid shell beyond the region; (c) providing direct cooling to the embryonic ingot by directing a supply of a first coolant liquid in a first amount onto an outer surface of the embryonic ingot emerging from the region where the metal is peripherally confined at a first amount; (d) removing the first coolant liquid from the outer surface of the embryonic ingot at a first location along the outer surface of the ingot where a cross section of the ingot perpendicular to the direction of advancement intersects a portion of the molten core such that internal heat from the molten core reheats the solid shell adjacent to the molten core after removing the first coolant; and (e) providing further direct cooling to the outer surface of the embryonic ingot following the removing of the first coolant liquid by applying a second coolant liquid to the outer surface at a second location, further along the ingot from the first location in the direction of advancement, where a cross section of the ingot perpendicular to the direction of advancement intersects a portion of the molten core, the second coolant liquid being applied in a second amount that is less than the first amount of the first coolant liquid, and that is effective to quench the embryonic ingot without preventing the temperatures of the core and shell from subsequently approaching a convergence temperature of 425° C. (797° F.) or higher for a period of time of at least 10 minutes following the quench.

By the expression "to quench the embryonic ingot", we mean that the temperature of the embryonic ingot is rapidly reduced not only at the outer surface but also extending into the interior of the ingot to affect the molten sump.

Furthermore, the requirement that the second coolant liquid be applied in an amount less than that of the first coolant liquid refers to the relative amounts applied to the ingot surface, i.e. volumes of liquid per unit time (e.g. per second) per unit of linear measure (e.g. per centimeter or inch) across the surface of the ingot in a direction perpendicular to the direction of advancement of the ingot from the mold in those regions of the ingot surface where both the first and second coolant liquid are sequentially applied. The first coolant liquid is generally applied all around the periphery of the ingot, whereas the second coolant liquid may be confined to certain parts of the periphery, such as central regions of the rolling faces of rectangular ingots. Therefore the comparison of amounts applies to those regions that are subjected to jets or sprays of both coolant liquids as the ingot advances away from the exit of the mold.

In the above method, the second location is preferably separated from the first location in the direction of advancement by a distance in a range of 150 to 450 mm, and the quench coolant liquid is preferably applied in an amount that is in a range of 4 to 20% of the amount of the primary liquid coolant applied in the first location.

According to another exemplary embodiment of the invention, there is provided apparatus for casting a metal ingot, comprising: (a) an open-ended direct chill casting mold having a region where molten metal supplied to the mold through a mold inlet is peripherally confined by mold walls, thereby providing molten metal supplied to the mold with a peripheral portion, and a mold outlet receiving a movable bottom block; (b) a chamber surrounding the mold walls for containing a primary coolant to cool the mold walls and thereby cool the peripheral portion of the metal to form an embryonic ingot having an external solid shell and an internal molten core; (c) a movable support for the bottom block enabling the bottom block to advance away from the mold outlet in a direction of advancement while molten metal is introduced into the mold through the inlet, thereby enabling the formation of an embryonic ingot having the molten core and solid shell; (d) jets for directing a supply of first coolant liquid onto the outer surface of the embryonic ingot; (e) a wiper for removing the first coolant liquid from the outer surface of the embryonic ingot at a first location along the outer surface of the ingot where a cross section of the ingot perpendicular to the direction of advancement intersects a portion of the molten core; and (f) outlets for applying a second coolant liquid to the outer surface of the embryonic ingot at a second location where a cross section of the ingot perpendicular to the direction of advancement intersects a portion of the molten core, the outlets applying the second coolant liquid in an amount less than the first coolant liquid applied by the jets.

The above embodiments may have the effect of decreasing the recrystallized particles size after hot rolling of the ingot, and/or of decreasing the macrosegregation compared with an ingot produced by a conventional in-situ casting method.

Exemplary embodiments of the present invention are disclosed in the following with reference to the accompanying drawings, in which:

DETAILED DESCRIPTION OF THE INVENTION

The following description refers to the direct chill casting of aluminum alloys, but only as an example because other eutectic and peritectic alloys may exhibit the problems discussed earlier when subjected to DC in-situ casting.

Thus, the exemplary embodiment described below, and indeed the invention generally, is applicable to various methods of casting metal ingots, to the casting of most alloys, particularly light metal alloys, and especially those having a transformation temperature above 425° C. (79° F.), and especially above 450° C. (842° F.), and that benefit from homogenization after casting and prior to hot-working, e.g. rolling to form sheet or plate. In addition to alloys based on aluminum, examples of other metals that may be cast include alloys based on magnesium, copper, zinc, lead-tin and iron.

Figure 1:
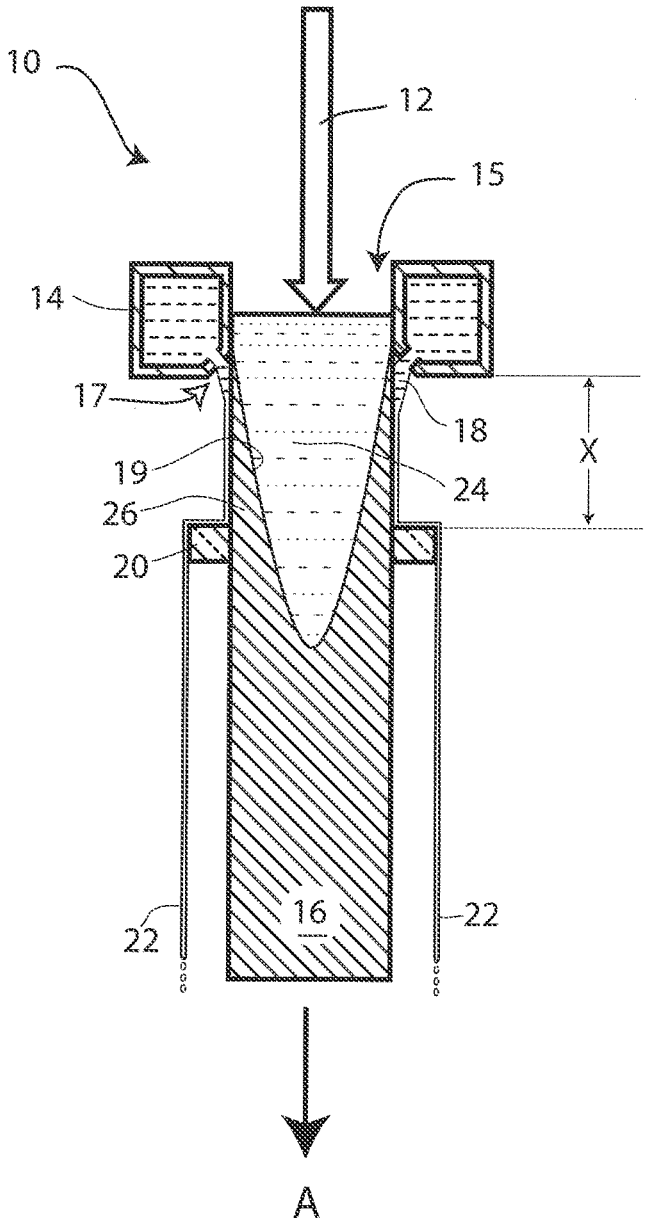
Fig. 1 (Prior Art)
FIG. 1 is a vertical cross-section of one form of a direct chill casting mold illustrating equipment for conventional casting with in-situ homogenization.

FIG. 1 of the accompanying drawings is a duplication of FIG. 1 of U.S. Pat. No. 7,516,775 and is provided to illustrate apparatus and equipment used for in-situ homogenization. The figure shows a simplified vertical cross-section of a vertical DC caster 10. It will, of course, be realized by persons skilled in the art that such a caster may form part of a larger group of casters all operating in the same way at the same time, e.g. forming part of a multiple casting table.

Molten metal 12 is introduced into a vertically orientated water-cooled open-ended mold 14 through a mold inlet 15 and emerges as an ingot 16 from a mold outlet 17. The upper part of the ingot 16 where the ingot is embryonic has a molten metal core 24 forming an inwardly tapering sump 19 within a solid outer shell 26 that thickens at increasing distance from the mold outlet 17 as the embryonic part of the ingot cools, until a completely solid cast ingot is formed at a certain distance below the mold outlet 17. It will be understood that the mold 14, which has liquid-cooled mold walls (casting surfaces) due to liquid coolant flowing through a surrounding cooling jacket, provides initial primary cooling of the molten metal, peripherally confines and cools the molten metal to commence the formation of the solid shell 26, and the cooling metal moves out and away from the mold through the mold outlet 17 in a direction of advancement indicated by arrow A. Jets 18 of coolant liquid are directed from the cooling jacket onto the outer surface of the ingot 16 as it emerges from the mold in order to provide direct cooling that thickens the shell 26 and enhances the cooling process. The coolant liquid is normally water, but possibly another liquid may be employed, e.g. ethylene glycol, for specialized alloys such as aluminum-lithium alloys.

A stationary annular wiper 20 of the same shape as the ingot (normally rectangular) is provided in contact with the outer surface of the ingot spaced at a distance X below the outlet 17 of the mold and this has the effect of removing coolant liquid (represented by streams 22) from the ingot surface so that the surface of the part of the ingot below the wiper is free of coolant liquid as the ingot advances further. Streams 22 of coolant are shown pouring from the wiper 20, but they are separated from the surface of the ingot 16 by such a distance that they do not provide any significant cooling effect.

The distance X (between the mold outlet and the wiper) is made such that removal of coolant liquid from the ingot takes place where the ingot is still embryonic (i.e. at a position where the ingot still contains the molten center 24 within sump 19 held within the solid shell 26). Put another way, the wiper 20 is positioned at a location where a cross-section of the ingot taken perpendicular to the direction of advancement A intersects a portion of the molten metal core 24 of the embryonic ingot. At positions below the upper surface of the wiper 20 (where the coolant is removed), continued cooling and solidification of the molten metal within the core of the ingot liberates latent heat of solidification and sensible heat to the solid shell 26 that had earlier been chilled by the jets 18. This transference of latent and sensible heat from the core to the shell, in the absence of continued forced (liquid) direct cooling, causes the temperature of the solid shell 26 (below the position where the wiper 20 removes the coolant) to rise (compared to its temperature immediately above the wiper) and converge with that of the molten core at a temperature that is arranged to be above a transformation temperature at which the metal undergoes in-situ homogenization. At least for aluminum alloys, the convergence temperature is generally arranged to be at or above 425° C. (797° F.), and more preferably at or above 450° C. (842° F.). For practical reasons in terms of temperature measurement, the "convergence temperature" (the common temperature first reached by the molten core and solid shell) is taken to be the same as the "rebound temperature" which is the maximum temperature to which the outer surface of the solid shell rises in this process following the removal of secondary coolant liquid, and is a temperature that is much easier to monitor.

The rebound temperature is preferably caused to go as high as possible above 425° C. (797° F.), and generally the higher the temperature the better is the desired result of in-situ homogenization, but the rebound temperature will not, of course, rise to the incipient melting point of the metal because the cooled and solidified outer shell 26 absorbs heat from the core and imposes a ceiling on the rebound temperature. It is mentioned in passing that the rebound temperature, being generally at least 425° C. (797° F.), will normally be above the annealing temperature of the metal (annealing temperatures for aluminum alloys are typically in the range of 343 to 415° C. (650 to 779° F.)).

The temperature of 425° C. (797° F.) is a critical temperature for most aluminum alloys because, at lower temperatures, rates of diffusion of metal elements within the solidified structure are too slow to normalize or equalize the chemical composition of the alloy across the metal grains. At and above this temperature, and particularly at and above 450° C. (842° F.), diffusion rates are suitably fast to produce a desirable equalization to cause in-situ homogenizing of the metal.

In fact, it is often desirable to ensure that the convergence temperature reaches a certain minimum temperature above 425° C. (797° F.). For any particular alloy, there is usually a transition temperature between 425° C. (797° F.) and the melting point of the alloy, for example a solvus temperature or a transformation temperature, at and above which certain microstructural changes of the alloy take place, e.g. conversion from β-phase to α-phase constituent or intermetallic structures. If the convergence temperature is arranged to exceed such a transformation temperature, further desired transformational changes can be introduced into the structure of the alloy.

Full details of the in-situ homogenization process and apparatus can, as mentioned, be obtained from the disclosure of U.S. Pat. No. 7,516,775.

Figure 2:
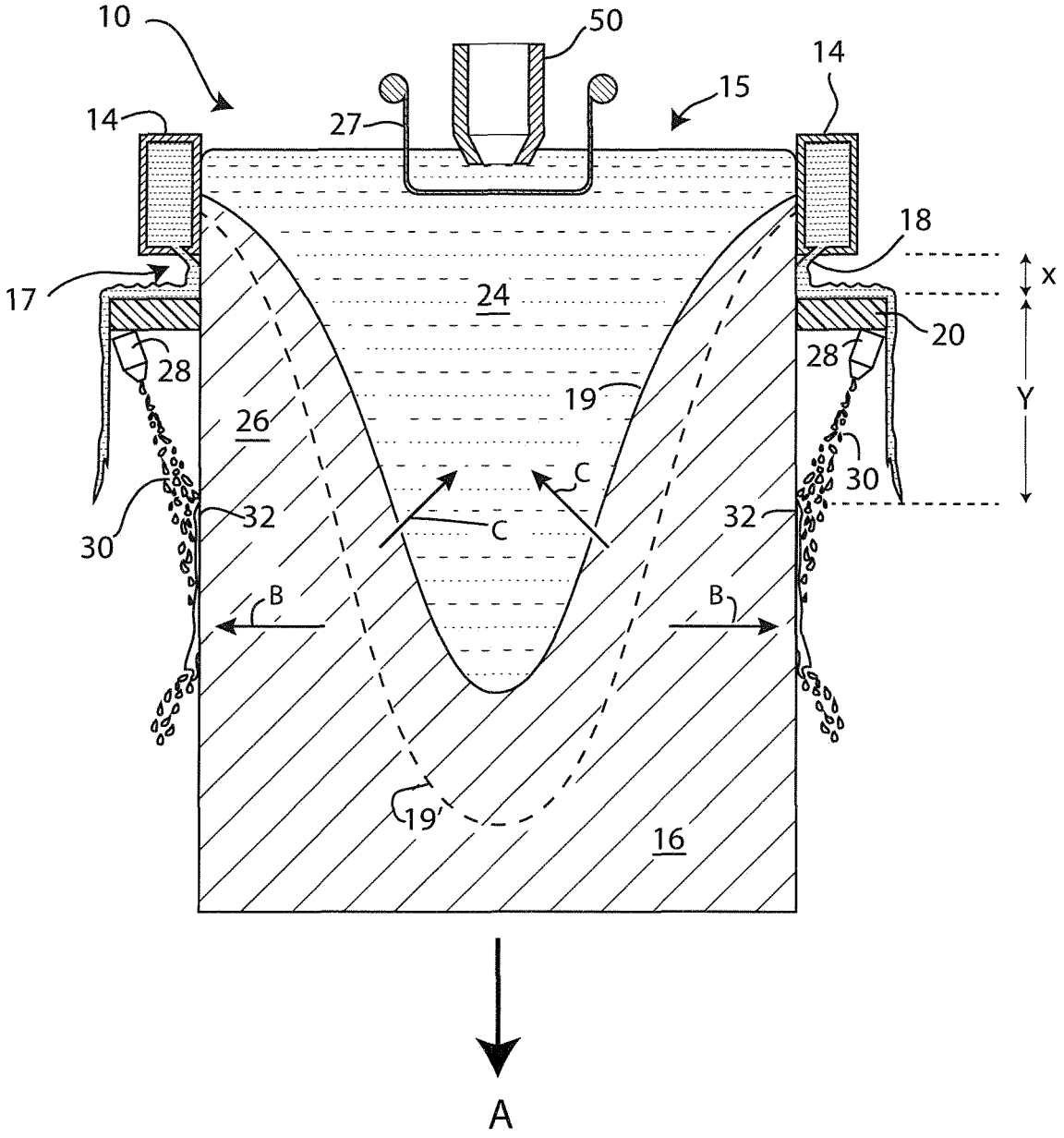
FIG. 2 is a cross-section similar to that of FIG. 1, but illustrating one exemplary embodiment of the present invention.

FIG. 2 of the accompanying drawings illustrates one form of apparatus according to an exemplary embodiment of the invention. The apparatus is, in part, similar to that of FIG. 1 and so similar or identical parts have been identified with the same reference numerals as those used in FIG. 1. As in the case of FIG. 1, this view is a vertical cross-section of a rectangular direct chill casting apparatus 10 shown in the process of casting a rectangular ingot 16 having large opposed faces 25A (see FIG. 3A), generally referred to as rolling faces, and narrow opposed end faces 25B. The cross-section of FIG. 2 is taken along a central vertical plane parallel to the narrow end faces 25B of the ingot and shows an embryonic ingot having a tapering molten metal sump 19 of still-molten metal 24. A vertical cross-section at right angles to the one shown (taken on a central vertical plane parallel to the rolling faces 25A) would be similar, except that, in view of the greater width of the ingot in this direction, the bottom of the sump would be essentially flat approximately between the quarter points of the thickness of the ingot (i.e. between points located at ¼ and ¾ of the distance across the ingot from the narrow ends). As in the case of FIG. 1, the apparatus has a vertically orientated water-cooled open-ended mold 14, a mold inlet 15 and a mold outlet 17. Molten metal is introduced into the mold through a spout 50 which discharges the metal through a removable metal mesh filter bag 27 designed to distribute the incoming metal in the ingot head. The metal undergoes primary cooling in the mold 14 and starts to form a solid shell 26 in contact with the mold walls. The embryonic ingot emerges from the mold outlet 17 where it is supplied with liquid coolant from jets 18 providing direct metal cooling for the exterior of the ingot 16. The apparatus is also provided with a wiper 20 that, as in the embodiment of FIG. 1, fully encircles the embryonic ingot 16 emerging from the mold outlet and serves to wipe away the coolant liquid provided by jets 18 so that the coolant remains in contact with the outer surface of the ingot only for distance X below the mold outlet. As for the apparatus of FIG. 1, the wiper 20 is located at a position on the ingot where the ingot is still embryonic, i.e. where the ingot has a solid shell 26 surrounding a sump 19 containing still molten metal 24 so that the apparatus is effective for causing the metal of the shell to undergo in-situ homogenization as the ingot descends. Unlike the apparatus of FIG. 1, however, the apparatus of FIG. 2 is provided with a number of nozzles 28, at least in the central regions of the large rolling faces 25A, that issue downwardly-directed sprays 30 of liquid coolant onto the outer previously-wiped surface of the ingot. The sprays provide the ingot with a so-called "quench", or further direct cooling of the ingot. The coolant of the sprays 30 may be the same as the liquid coolant of jets 18 and is usually water. Indeed, if desired, the sprays 30 may be made up of coolant water earlier removed from the ingot by wiper 20 and redirected through the nozzles 28. The nozzles 28 are angled inwardly and downwardly so that the sprays 30 contact the outer surface of the ingot at locations 32 that are a distance Y below the point where the wiper 20 removes liquid coolant from the outer surface of the ingot (i.e. from the upper surface of the wiper 20). The locations 32 are taken to be the points where the main streams of the sprays 30 first contact the outer surface of the ingot. At normal casting speeds (e.g. of 30 to 75 mm/min (1.18-2.95 in/min), more commonly 40-65 mm/min (1.57-2.56 in/min) and often about 65 mm/min (2.56 in/min), the distance Y is preferably within the range of 150 to 450 mm (5.9-17.7 inches), more preferably 250 to 350 mm (9.8 to 13.8 inches), and generally around 300 mm (11.8 inches)±10%. Speeds greater than 75 mm/min (2.95 in/min) are not currently common in the industry, but the technique disclosed herein would still be applicable given minor adjustments. As casting speeds are increased, the distance Y is normally also made to increase because a greater distance from the wiper is then needed to allow the metal shell to rebound in temperature from the effects of the secondary cooling. It is generally preferably to allow the outer shell to rebound in temperature by at least 100° C. (212° F.), and possibly up to about 400° C. (752° F.), although a common range is 200 to 400° C. (392 to 752° F.) over the distance Y. Thus, the outer shell decreases in temperature as it leaves the mold outlet and encounters the coolant liquid jets 18, rebounds in temperature after this coolant liquid has been removed by the wiper to reach a first rebound temperature, is then reduced in temperature again when undergoing the quench provided by sprays 30, and then increases again in temperature to a second rebound temperature as the effect of the quench coolant recedes and heating from the still-molten core predominates. Thus, the outer shell ultimately reaches a second rebound temperature (which is an indicator of the achievement of a convergence of temperatures between the shell and molten core as required for in-situ homogenization) before gradually cooling to ambient temperature (which may take several hours or days of cooling in air).

The temperature of the outer surface of the ingot 16 at the locations 32 is generally high enough to cause nucleate boiling, or even film boiling, of the quench liquid and the resultant evaporation and diversion of the liquid from the metal surface (due to steam formation or splashing) generally means that the distance along the ingot surface from locations 32 where quench cooling is effective may be quite limited (e.g. no more than a few inches).

The purpose of the quench provided by the sprays 30 is to remove sufficient heat from the ingot that the molten sump at position 19' shown by the broken line (which is the position where the walls of the sump would form in the absence of the quench from sprays 30) becomes more shallow and forms an actual sump 19 in the position shown by the solid line. That is to say, the embryonic ingot becomes fully solid at a higher point in the ingot when the sprays 30 are active than would be the case in the absence of such cooling. As shown by arrows B, heat is removed from the interior of the ingot by the coolant from the sprays 30 and this has the effect of raising the sump as represented by arrows C. By this means, it may be possible to raise the sump by 100 to 300 mm, or more usually 150 to 200 mm, depending on the size of the ingot and other variables. As can be seen in FIG. 2, the result of the tertiary cooling is a shallower sump 19 with a wall having a smaller angle relative to the horizontal than the angle of the wall formed in the absence of tertiary cooling 19'. Another result not visible in FIG. 2 is the formation of a thinner mushy zone as a result of the additional cooling from the sprays 30. These two effects combined can reduce the macrosegregation realized in the fully solidified ingot due to solidification shrinkage, thermal-solutal convection, and floating grains.

As noted, the quench coolant liquid (sprays 30) is first applied at a location on the ingot where, but for the tertiary cooling effect, the ingot would still be embryonic, i.e. a position where the adjacent core would still be molten. The quench cooling itself decreases the sump depth, but not so much that the ingot become fully solid at this location. That is to say, following the quench, the ingot still has a liquid core that causes the temperature of the outer shell to rebound following the cooling. In fact, the tertiary coolant sprays 30 are preferably applied at a location corresponding to about half, or a little less, of the pre-quench cooling sump depth (depth of molten metal at the center of the sump), and more preferably no more than three quarters of the pre-quench cooling sump depth. While the quench cooling is sufficient to decrease the sump depth, it should not be so great as to interfere with the desired in-situ homogenization that occurs after the quench. That is to say, the solid metal of the ingot must still experience a rebound temperature (second rebound temperature) above the transition temperature of the metal (e.g. above 425° C. (797° F.)) for a suitable time (normally at least 10 minutes and more preferably 30 minutes or more) to bring about a desired transformation of the metal structure. While the quench temporarily reduces the temperature of the outer solid metal shell from a first rebound temperature, its short duration and limited effect allows a suitable second surface temperature rebound once the quench coolant has dissipated. The short duration and limited effect of the quench effect is due in part to the nucleate or film boiling that takes place (which causes the coolant to evaporate and/or elevate from the surface), but it is also due to the use of a reduced rate volume of coolant liquid (per unit time and unit distance across the periphery of the ingot) compared to the volume (per unit time and unit distance) applied by jets 18 for the initial direct cooling. The volume of coolant liquid employed for quench cooling is preferably within a range of 2 to 25% of that employed for initial direct cooling, and more preferably within the range of 4 to 15%. If film boiling is encountered, a higher rate of flow may be required to compensate for the lack of contact with the surface in order to provide the desired degree of quench cooling. Generally, the coolant used for initial direct cooling may be applied in a range of 0.60 to 1.79 liters per minute per centimeter around the circumference of the ingot (lpm/cm) (0.40 to 1.2 US gallons per minute per linear inch at the circumference of the ingot (gpm/in)), and is more preferably 0.67 to 1.49 lpm (0.45 to 1.00 gpm/in). Then, the coolant used for quench cooling may be applied via sprays 30 at a rate in a range of preferably 0.042 to 0.140 lpm/cm (0.028 to 0.094 gpm/in), and more preferably 0.057 to 0.098 lpm/cm (0.038 to 0.066 gpm/in).

Figure 3A:
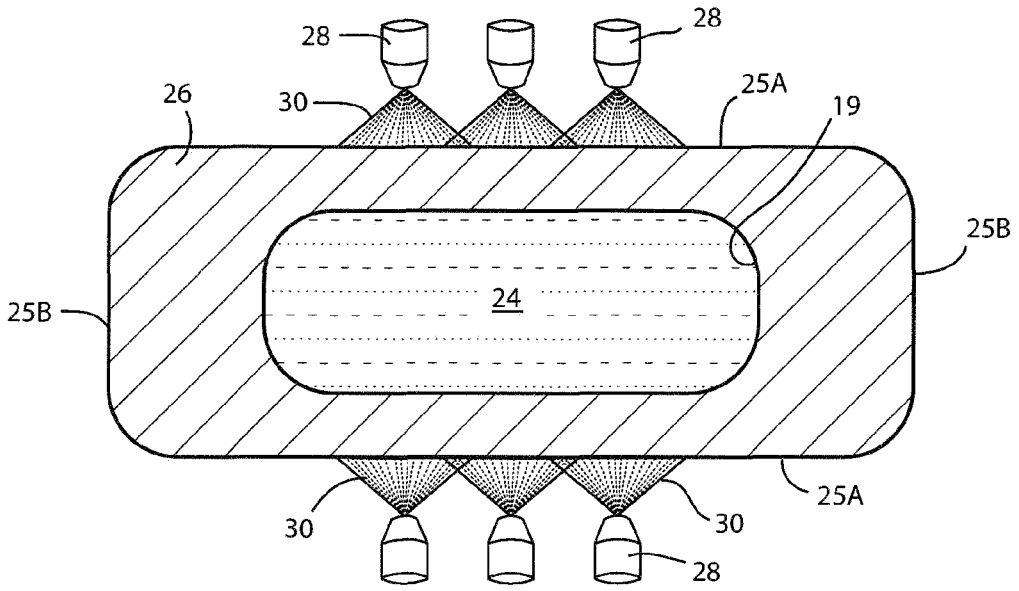
FIG. 3A is a horizontal schematic cross-section of the ingot of FIG. 2 below the wiper showing the nozzles and sprays used for tertiary ingot cooling (water quench)
Figure 3B:
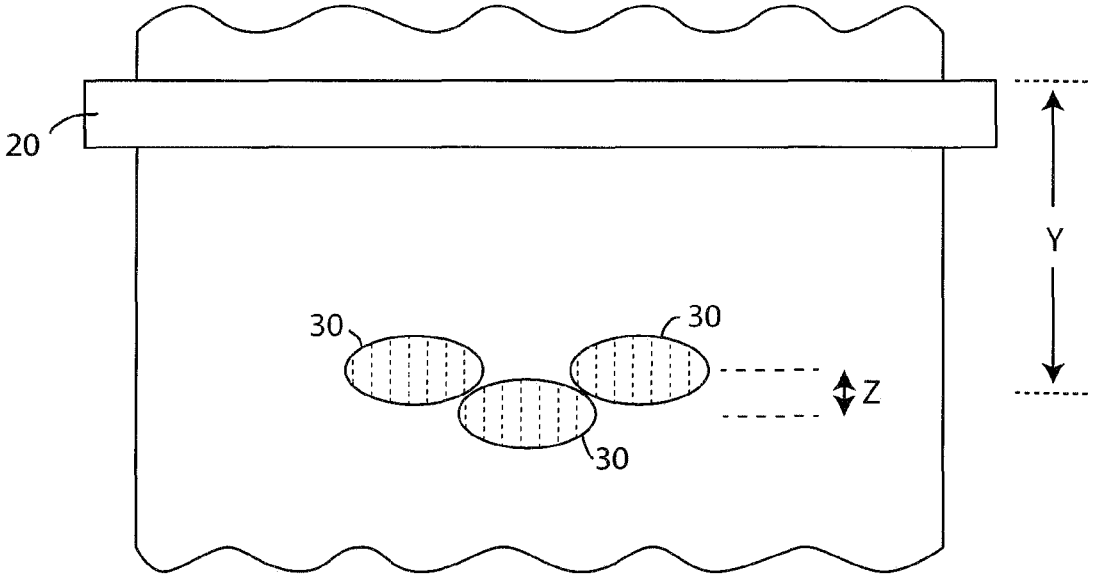
FIG. 3B is a partial side view of the ingot shown in FIG. 3A schematically illustrating the positions where the tertiary cooling sprays contact the ingot face.

As best seen from FIGS. 3A and 3B, the coolant for the quench is preferably applied in the form of sprays 30 that are V-shaped (increasing in width with distance from the nozzle) with a fairly low coolant flow that may result in the formation of droplets before the sprays reach the ingot surface. Alternatively, the sprays 30 may be conical (circular in cross-section) or essentially linear (elongated thin horizontal stripes), or indeed any shape that produces an even distribution of coolant across the surface of the ingot without causing uneven patterns of coolant flow. The sprays generally overlap at the extreme edges, but not by so much that uneven cooling zones are produced across the surface of the ingot surface. In fact, in one embodiment, the spray nozzles may be angled in such a manner that the contact areas of the sprays 30 are offset vertically in an alternating manner, e.g. as shown in FIG. 3B. This figure shows the three sprays of FIG. 3A offset vertically by a distance Z that is generally one inch (2.54 cm) or less. While there is no direct overlap of the initial contact areas of the sprays 30 due to the vertical spacing, the initial contact areas have a slight overlap considered in the horizontal direction so that there is no gap in the cooling of the ingot face as the ingot progresses downwardly past the nozzles 28, but the lack of direct overlap prevents the interaction between the sprays that may cause unusual water flow patterns and consequently unusual cooling. The distance Y (distance between secondary coolant removal and contact with the sprays 30) is based on the average vertical position of the contact areas of the sprays, as shown in FIG. 3A and varies according to ingot size and casting conditions (e.g. casting speed) as mentioned above.

It is generally sufficient to apply the quench coolant continuously over the middle width of the larger rolling faces of the rectangular ingot, so that there is no need to apply the quench coolant to the narrow edge faces 25B or the corner regions of the large rolling faces 25A. Ideally, the quench cooling is applied to a region directly adjacent to the molten sump within the core of the embryonic ingot to cause the desired raising of the sump. The number of nozzles 28 required to achieve the desired region of application will depend on the size of the ingot and casting conditions, the distance between the nozzles and the ingot surface and the spread of the sprays 30. Normally, however, it may be sufficient to provide only three or four quench nozzles for each long rolling face of the ingot.

The application of the quench coolant may reduce the surface temperature of the ingot surface by 200° C. (392° F.) or more, e.g. 200-250° C. (392-482° F.) or even as much as 400° C. (752° F.), but after the cooling effect dissipates the temperature rises again above a transformation temperature, e.g. above 425° C. (797° F.) and possibly to as much as 500° C. to 560° C. (932 to 1040° F.) at points below the locations of contact 32 of the sprays 30. The surface temperature may then remain above the transformation temperature for a period of at least 10 minutes, and normally longer, e.g. 30 minutes or more, to enable in-situ homogenization to take place. During this time, and until the ingot reaches ambient temperature, it may be allowed to cool slowly in contact with air.

While the apparatus of FIG. 2 employs a physical wiper 20 made, for example, of a heat-resistant elastomeric material, it may be advantageous to use a fluid instead to remove the coolant liquid of jets 18 from the surface of the ingot at the desired distance X from the mold. For example, it is possible to employ water jets to remove the coolant liquid, as disclosed in U.S. Patent Application Publication No. 2009/0301683 to Reeves et al., the disclosure of which is specifically incorporated herein by this reference.

It is also possible to adjust the vertical position of the wiper 20 at different stages of the casting operation (as disclosed in U.S. Pat. No. 7,516,775) to vary the distance X, in which case the vertical positions of nozzles 28 may be adjusted by a similar amount to maintain a desired distance Y.

While the exemplary embodiments may be suitable for ingots of any size, they are particularly effective when applied to large ingots where the sump depth tends to be large and the detrimental effects, e.g. formation of large granules and macro-segregation, are more pronounced. For example, the embodiments are particularly suitable for rectangular ingots having a size of 400 mm or larger on the shorter side face.

Specific Examples of the invention are described below in order to provide further understanding. These Examples should not be considered to limit the scope of the present invention as they are provided for illustration purposes only.

EXAMPLES

Experimental ingot castings were carried out to investigate the effects of direct chill casting with in-situ homogenization both with and without a quench (tertiary cooling) to investigate the effects of exemplary embodiments of the invention. The results obtained are illustrated in FIGS. 4 to 19 of the accompanying drawings.

First, a brief description of each sample discussed below. These samples are listed in chronological order and not in the order that they appear below.

Sample 1 is a test sample cast in a production center on a 600×1850 mm mold (23.6×72.8 inch) with a cast speed of 68 mm/min (2.68 in/min). This cast used the normal DC casting practice.

Sample 2 is from the same cast as Sample 1, but from a different ingot that underwent the in-situ homogenization method. This resulted in a maximum rebound temperature of 500° C. (1022° F.). Sample 2 refers to a slice cut from this ingot, with multiple points of interest examine across the width and thickness of the slice.

Samples 3A and 3B were cast in a research facility on a 560×1350 mm mold (22×53.1 inch). While this is a smaller mold, the ingot widths are similar (600 vs. 560), which is the important matter. The cast speed was similar to the production ingot's as well, at 65 mm/min (2.56 in/min). Sample 3A was taken at 700 mm (27.6 inches) cast length. It was subjected to a normal in-situ homogenization in an attempt to reproduce the same structure as was found in Sample 2. Sample 3B was taken at 1900 mm (74.8 inches) cast length and was subjected to tertiary cooling.

Samples 4A and 4B are from a 560×1350 mm mold (22×53.1 inch) with in-situ homogenization and tertiary cooling. These samples are from 1200 mm (47.2 inches) and 1900 mm (74.8 inches) of cast length respectively.

Samples 5A and 5B are also from a 560×1350 mm mold (22×53.1 inch). Some small adjustments were made to the in-situ homogenization wiper and the setup of the tertiary cooling relative to Sample 4. Sample 5A is from 1000 mm (39.4 inches) cast length and Sample 5B is from 1900 mm (74.8 inches) cast length.

Figure 4:
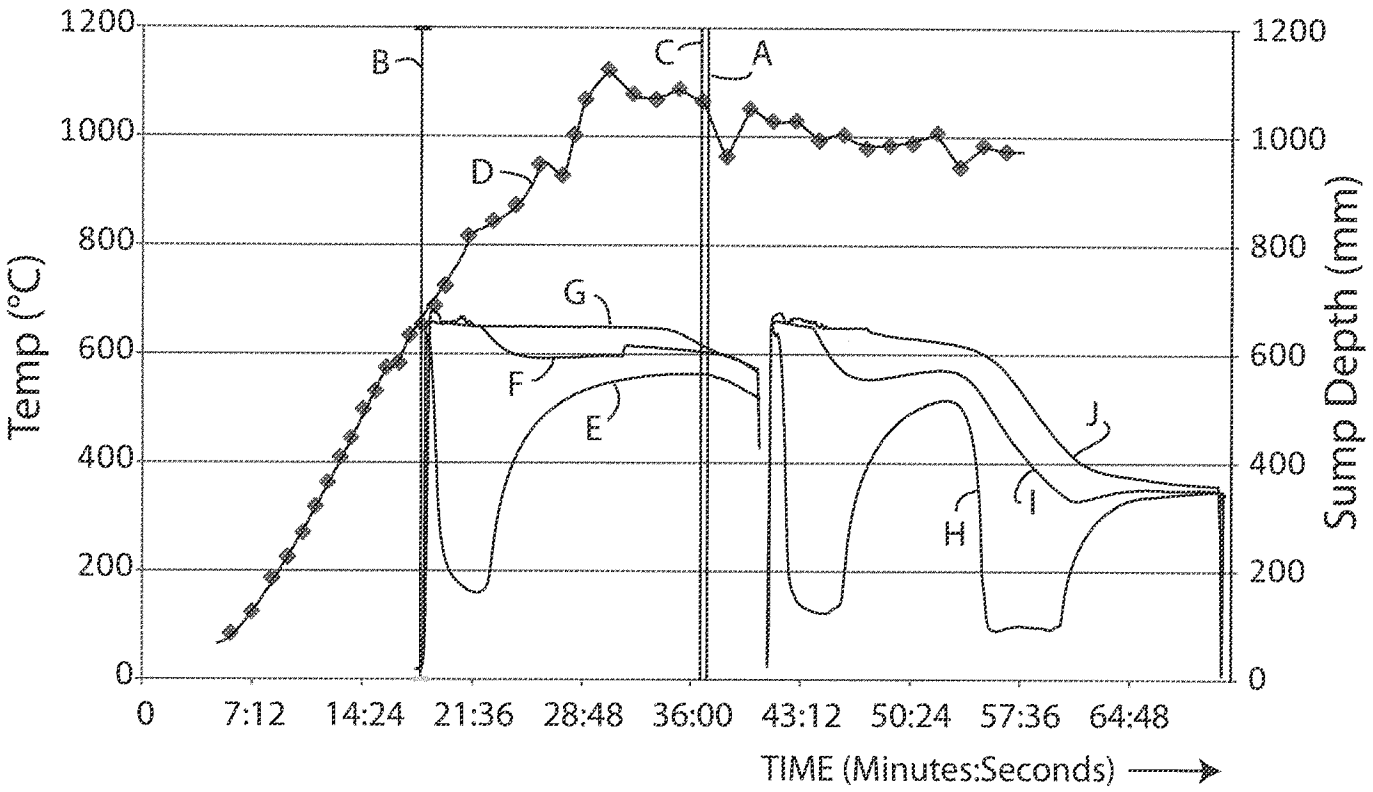
FIGS. 4 to 9, 10A, 11A, 12A, 13A, 14A, 14B, 15A and 15B and are graphs showing the results of experiments carried out and discussed in the Examples section of the description below.

Sample 6 is again from a 560×1350 mm mold (22×53.1 inch) mold with adjustments to the in-situ homogenization wiper and the tertiary cooling. This particular sample was taken from a point from the surface that was found to have very high macrosegregation for analysis of the coarse constituents. FIG. 4 shows the results of a DC casting operation which commenced merely with the application and subsequent wiping of secondary coolant, but wherein tertiary cooling (quench) was also applied partway through the casting operation. Thermocouples were embedded in the embryonic ingot at various points throughout the cross-section (at the surface, quarter and center) and they moved downwardly as the ingot advanced from the mold, reporting the sensed temperatures as they did so. The figure shows the recorded temperatures against time from the start of casting. As noted, casting commenced without tertiary cooling, and the tertiary cooling was turned on at the time indicated by line A. Line B indicates when the ingot reached a length of 700 mm (27.5 in) and line C indicates when the ingot reached a length of 1900 mm (74.8 in). The figure also shows by line D the measured depth of the sump against casting time. Two sets of embedded thermocouples were used, the second set being embedded following the turning on of the tertiary cooling water. Lines E, F and G show the temperatures sensed by the initial surface, quarter and center thermocouples, respectively, and lines H, I and J show the temperatures sensed by the second surface, quarter and center thermocouples. Samples 3A and 3B were taken from this cast.

The first half of the graph shows the surface temperature (line E) initially falling when encountering the secondary cooling water, but rebounding to 550+° C. (1022+° F.) following "wiping" and approaching the temperature of the molten metal in the center (line G). The second half of the graph shows a similar temperature fall and rebound (to 500+° C. (1022° F.)) in the surface temperature following secondary cooling and wiping (line H), and a further decline in temperature when encountering the tertiary cooling water. In this case, the surface temperature following tertiary cooling did not rebound sufficiently because the temperature remained below 400° C. (752° F.), i.e. not hot enough to properly modify the characteristics of the cast structure. It was considered that too much tertiary cooling was employed in this case.

The graph shows that the measured sump depth reached about 1050 mm prior to the tertiary cooling being turned on.

Figure 5:
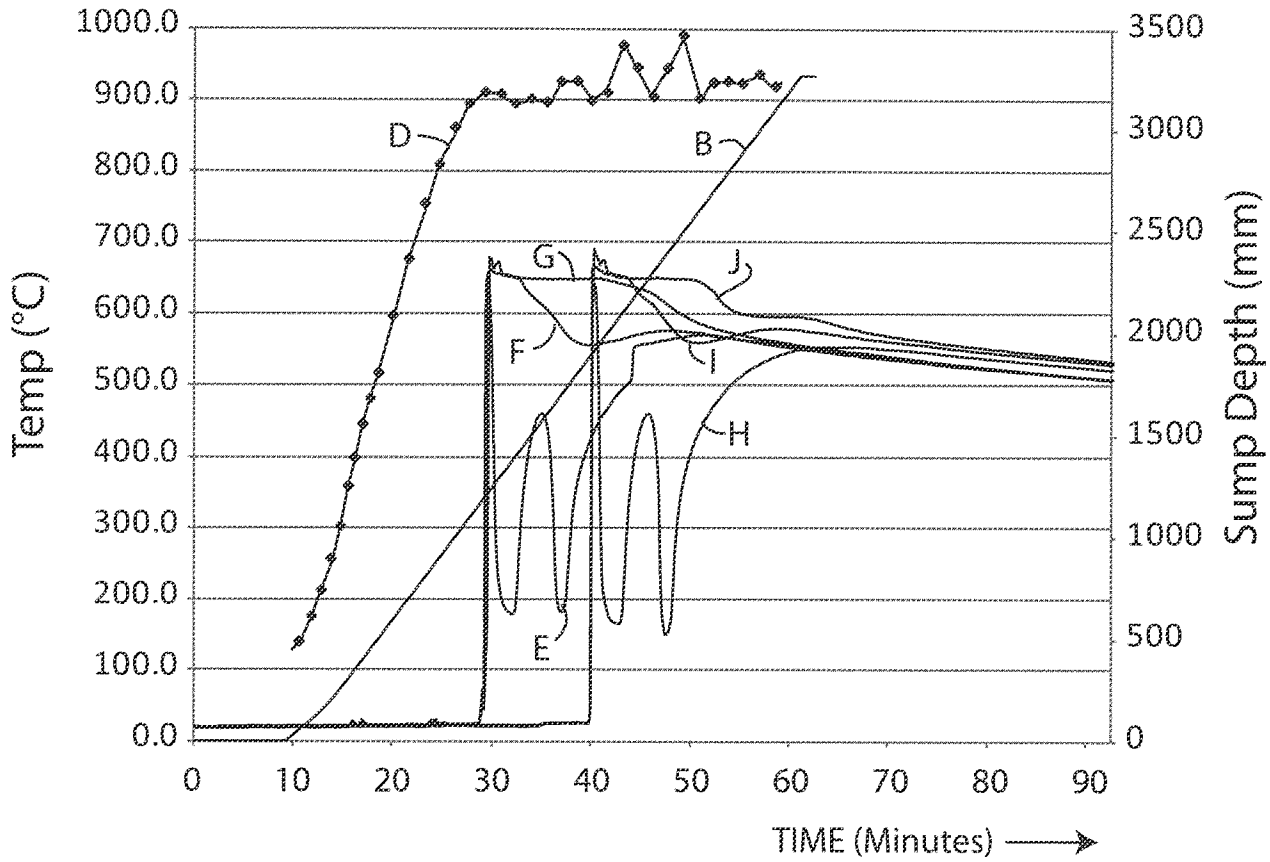

FIG. 5 is a graph similar to FIG. 4, but showing a DC casting with both wiping of secondary cooling water and subsequent application of tertiary cooling water (quench)

throughout. The sump depth is indicated by line D. Lines E, F and G represent the temperatures sensed by a first set of surface, quarter and center thermocouples, respectively, and lines H, I and J represent temperatures sensed by a second set of surface, quarter and center thermocouples, respectively. Line B represents the length of the casting against time. The surface, quarter, and center traces converge at 550° C. (1022° F.) following the quench, which is effective for in-situ homogenization. Line H shows that the ingot surface, following secondary cooling, rebounded to a temperature of about 460° C. (860° F.) (first rebound) before encountering the tertiary cooling (quench). Also, line D indicates that the measured sump is in the 900 mm (35.4 inch) range which is 150 mm (5.9 inches) shallower than would be the case without the tertiary cooling. Sample 4 was taken from this cast.

Figure 6:
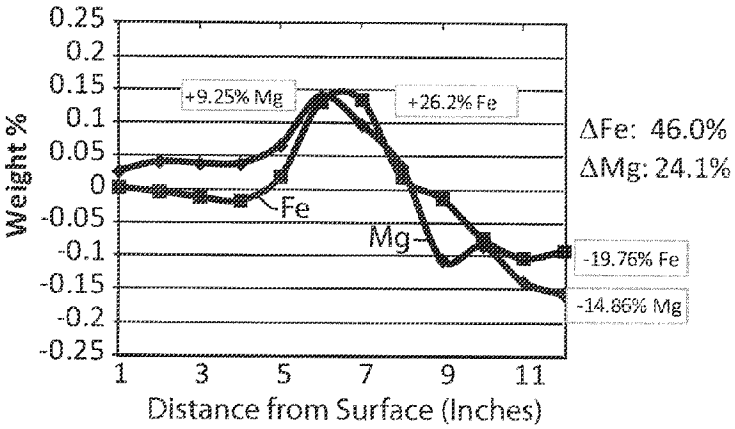

FIGS. 6 to 9 show the macrosegregation of ingots cast by the in-situ technique with and without tertiary cooling (quench). These measurements and graphs were originally made in inches, so the units will be discussed as such where appropriate. The ingots were cast from the same aluminum alloy (8135, which is a slightly more alloyed variant of commercial alloy AA3104 and will be referred to from herein as 3104) that contained Fe and Mg. Samples were taken from the ingots at points ranging from the surface to the center, and the differences of Fe and Mg contents from the standard (contents of the elements in molten alloy before solidification) were determined. The ordinates show the weight percent differences from the standard at the various points. A flat line at "0" would show no deviation of composition from the standard through the ingot. The abscissa shows the distance, in inches, from the surface of the ingot were the samples were taken. In the case of FIG. 6, Sample 2, the ingot was cast without tertiary cooling (quench). The ingot was 23-24 inches wide, so the sample at 12 inches was at or near the center of the ingot. The graph shows an increase of Fe and Mg between 5 and 8 inches from the surface and then a depletion of these elements further towards the center.

Figure 7:
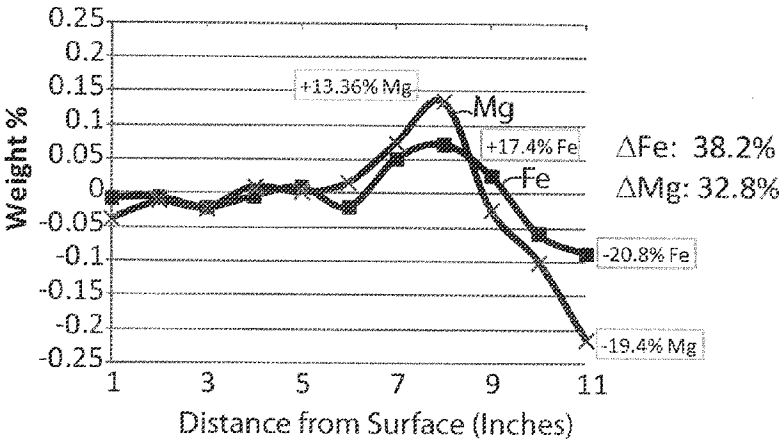

FIG. 7, which is Sample 3A, shows the variation of Fe and Mg from the surface to the center of a 22 inch thick ingot cast without tertiary cooling (i.e. with secondary cooling followed by wiping). A sample of molten metal was taken from the sump to act as the standard. Considering the Fe content, the sample at roughly 8 inches from the surface was enriched in Fe by +17.4% and the sample from the center was depleted in Fe by −20.8%.

Figure 9:
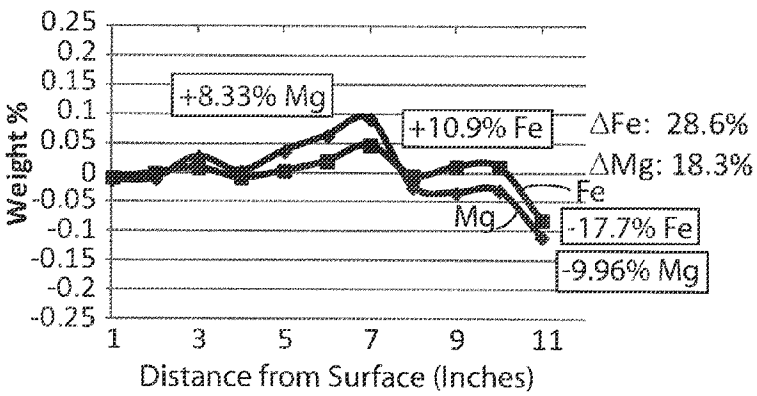
Figure 8:
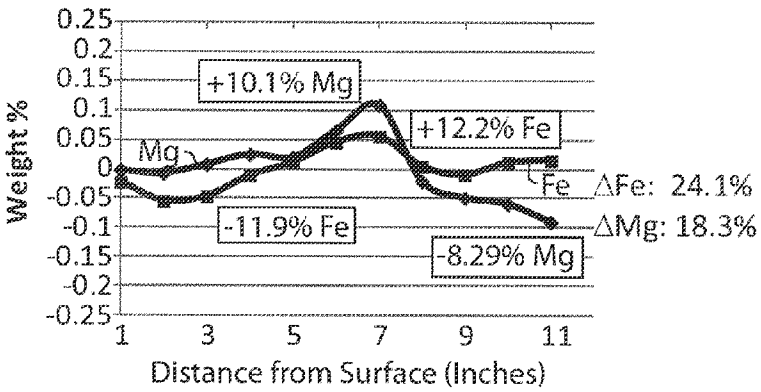

FIGS. 8 and 9 show results from Samples 4A and 4B, respectively. In FIG. 8, the maximum deviation for Fe occurred at 7 inches from the surface with an enriched percentage of +12.2%, but the sample at the center had a depleted value of −11.9%. In FIG. 9, for Fe, the deviation at 7 inches was +10.9% and at the center it was −17.7%. This shows, that for the in-situ homogenization without tertiary cooling (quench) of FIG. 6, the deviation in Fe macrosegregation was 38.2%, whereas for the in-situ with quench of FIGS. 8 and 9, the deviation was less than 24% at 1200 mm and less than 28.6% at 1900 mm.

Figure 10A:
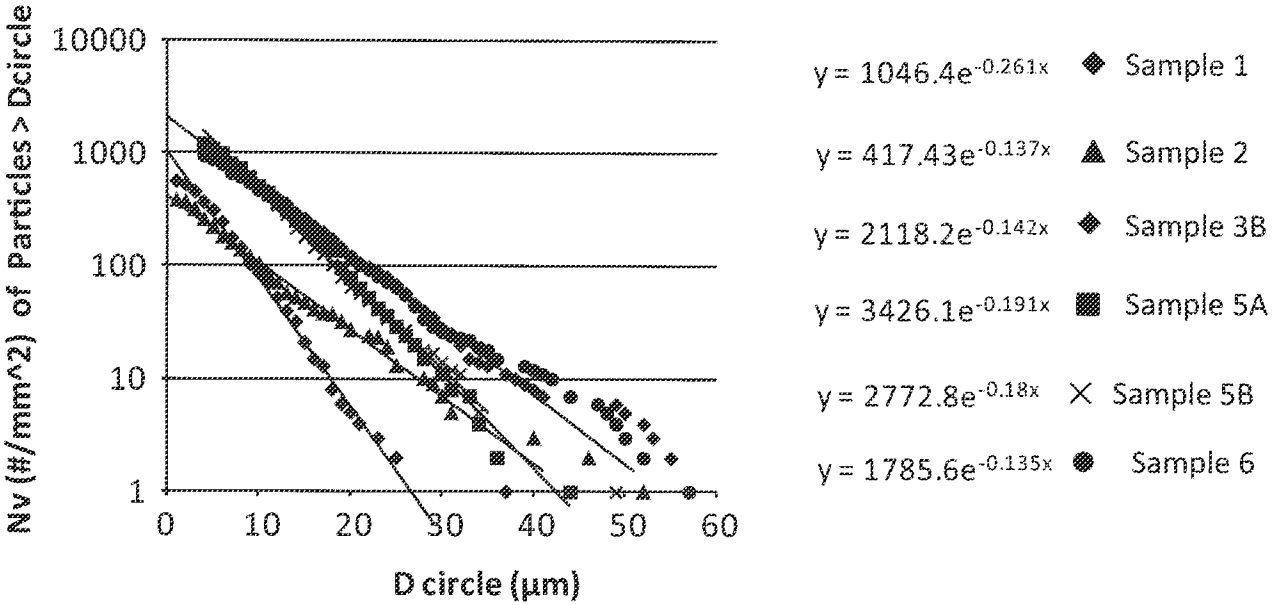
Figure 10B:
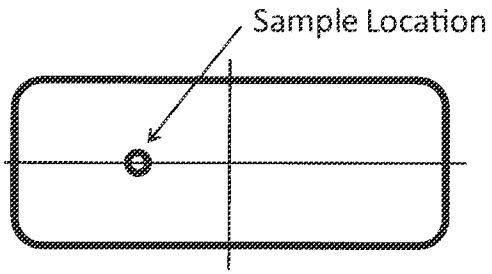
FIGS. 10B, 11B, 12B and 13B are diagrams showing the positions on the ingot where the samples used to generate the graphs of FIGS. 10A, 11A, 12A and 13A, respectively, were obtained.

The graph of FIG. 10A shows, for various castings of alloy 3104 (Samples 1, 2, 3B, 4B, 5A, 5B and 6), the diameters of the observed particles in μm on the abscissa and the number of particles of that size or larger on the ordinate, with the ordinate graphed logarithmically to yield a straight line. FIG. 10B shows the position in the ingots were the samples were taken (i.e. central thickness-quarter width or QC). Four castings were carried out with in-situ homogenization and quench, and these are Samples 3B, 5A, 5B and 6. Data was also supplied for castings produced by DC casting alone (identified as Sample 1), and DC casting with secondary cooling and wiping alone (Sample 2). The data showed that the quenched material had a greater overall number of particles. A steeper downward slope is more desirable, indicating that more of the particles are of a smaller size, and the graphs shows that the ingot from which Samples 5A and 5B were taken had a steeper slope. The sump depths of the castings are shown in Table 1 below, and the slopes of the curves are shown in Table 2.

TABLE 1

| Casting | Casting length | Sump Depth |
|---|---|---|
| Sample 3B | 1900 mm | 1067 mm |
| Sample 5A | 1000 mm | 806 mm |
| Sample 5B | 1900 mm | 946 mm |
| Sample 6 | 2000 mm | 1000 mm |

TABLE 2

| Casting | QC | CQ | QQ | CC |
|---|---|---|---|---|
| Sample 1 | −0.142 | N/A | N/A | N/A |
| Sample 2 | −0.191 | N/A | N/A | N/A |
| Sample 3B | −0.180 | N/A | N/A | N/A |
| Sample 5A | −0.135 | N/A | N/A | N/A |
| Sample 5B | −0.261 | N/A | N/A | N/A |
| Sample 6 | −0.137 | N/A | N/A | N/A |

Given that the graph is logarithmic, a best fit line using an exponential equation was used to determine the slope. (The power on the exponential function defines the slope). Due to the effects of macrosegregation, the graphed data points are not linear on the logarithmic graph. Since the purpose is to look at the effects on microsegregation, non-linear points were ignored and a line was applied only to the straight section of the data.

The DC ingot (Sample 1) and in-situ alone (Sample 2) 3104 ingots were also analyzed. Sample 1 had an exponent of −0.261, which is higher than any of the in-situ plus quench test ingots. However, Sample 2 had a value of −0.137. Looking at Sample 1 and Sample 2 as a best and worst case result, it can be seen that Samples 4 and 5 are moving in a desired direction.

On another occasion, the secondary coolant wiper was raised over an inch higher to improve the rebound temperature, and the quench nozzles were raised up 100 mm to reduce the first rebound and increase the squeezing effect on the ingot due to thermal contraction. Squeezing the ingot in this way reversed the mechanics that cause solidification shrinkage, thereby reducing macrosegregation. Analysis of this location showed a slight decrease in the coarse constituent size. For the cast that made Samples 5A and 5B, the wiper was positioned 50 mm (2 inches) below the mold, the quench bars were 300 mm (11.8 inches) below the head, and engaged the magnet (from outside the mold) after 1500 mm (59.0 inches) cast length. The first data point at 1000 mm (39.4 inches) shows a good improvement changing the exponent to −0.191. The second data point at 1900 mm (74.8 inches) is −0.180.

Figure 11A:
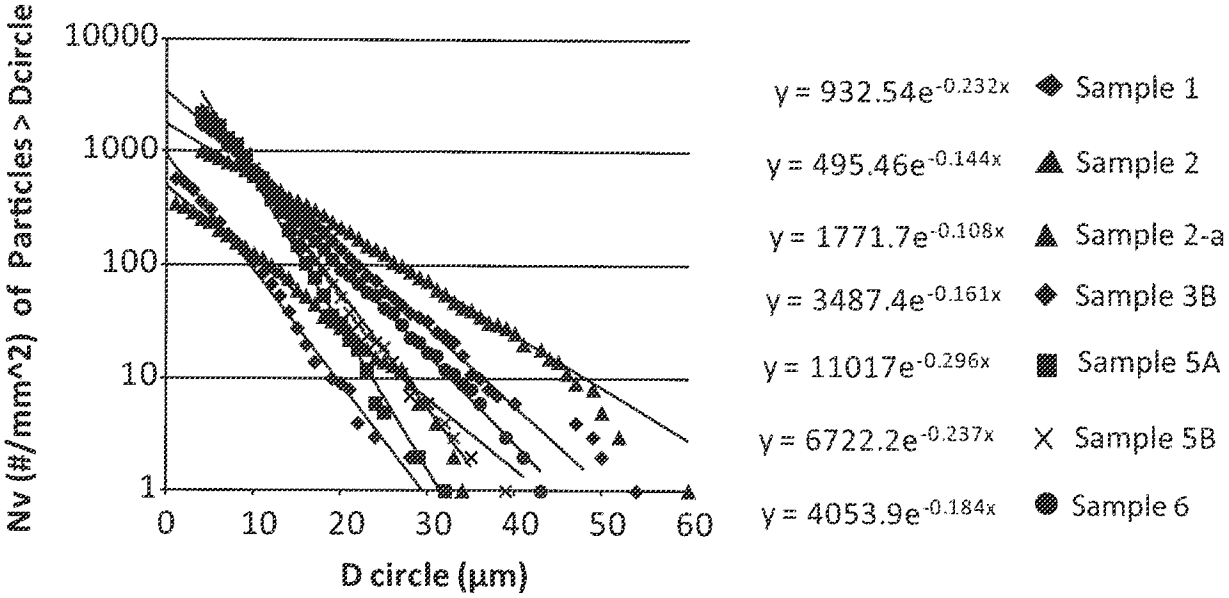
Figure 11B:
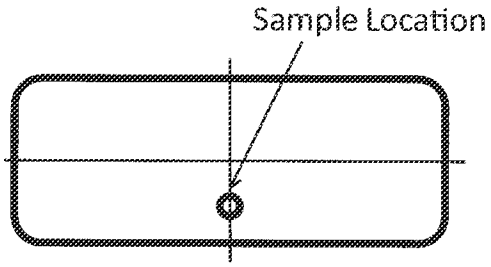

FIG. 11A shows the results for samples from the same castings, except sampled at the point shown in FIG. 11B (quarter thickness-center width or QC). There is also an additional sample from the point of highest macrosegregation in Sample 2, designated Sample 2-a. The intermetallic particles were much larger in this ingot than any of the test ingots with quench. That ingot had a negative exponent of 0.108. The sump depths of the castings were of course as shown in Table 1, and the slopes of the curves are shown in Table 4 (along with data from above).

TABLE 3

| Casting | QC | CQ | QQ | CC |
|---|---|---|---|---|
| Sample 1 | −0.142 | −0.161 | N/A | N/A |
| Sample 2 | −0.191 | −0.296 | N/A | N/A |
| Sample 3B | −0.180 | −0.237 | N/A | N/A |
| Sample 5A | −0.135 | −0.184 | N/A | N/A |
| Sample 5B | −0.261 | −0.232 | N/A | N/A |
| Sample 6 | −0.137 | −0.144 | N/A | N/A |

The sample 3B shows a negative exponent of 0.161. The changes for the 21$^{st}$ (detailed on previous slide) further improved the exponent, yielding −0.296 for the slice at 1000 mm.

Sample 2 is again the worst case scenario, with −0.144 in the CQ position. However, the DC value of −0.232 is actually less than the result from the April test, −0.237 and −0.296.

Figure 12A:
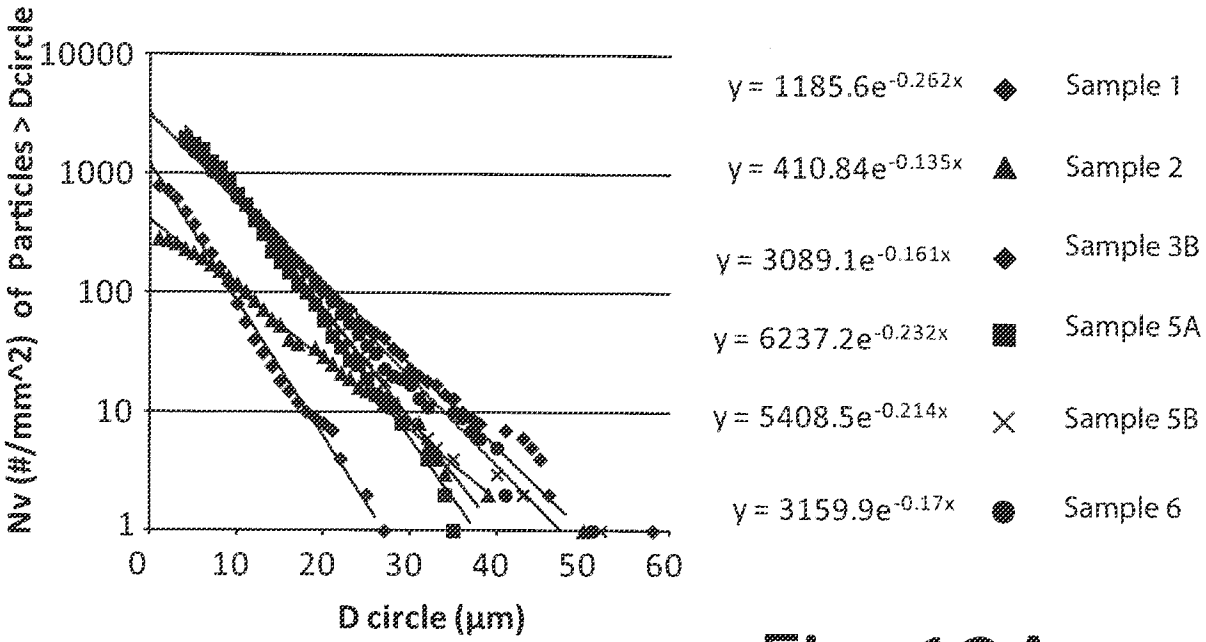
Figure 12B:
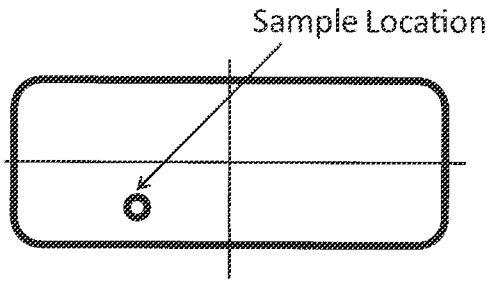

FIG. 12A shows the results of samples taken from the quarter width and quarter thickness (QQ) location as shown in FIG. 12B. The exponent data for Sample 5A yielded −0.232. Sample 2 is −0.135 and Sample 1 is −0.262. This time the production sample data brackets the rest of the results. The Sample 4 and 5 data was still an improvement over the production and initial testing results, and was getting closer to the DC target value (Sample 1).

The slopes for FIG. 12A are shown in Table 4 below.

TABLE 4

| Casting | QC | CQ | QQ | CC |
|---|---|---|---|---|
| Sample 1 | −0.142 | −0.161 | −0.161 | N/A |
| Sample 2 | −0.191 | −0.296 | −0.232 | N/A |
| Sample 3B | −0.180 | −0.237 | −0.214 | N/A |
| Sample 5A | −0.135 | −0.184 | −0.170 | N/A |
| Sample 5B | −0.261 | −0.232 | −0.262 | N/A |
| Sample 6 | −0.137 | −0.144 | −0.135 | N/A |

Figure 13A:
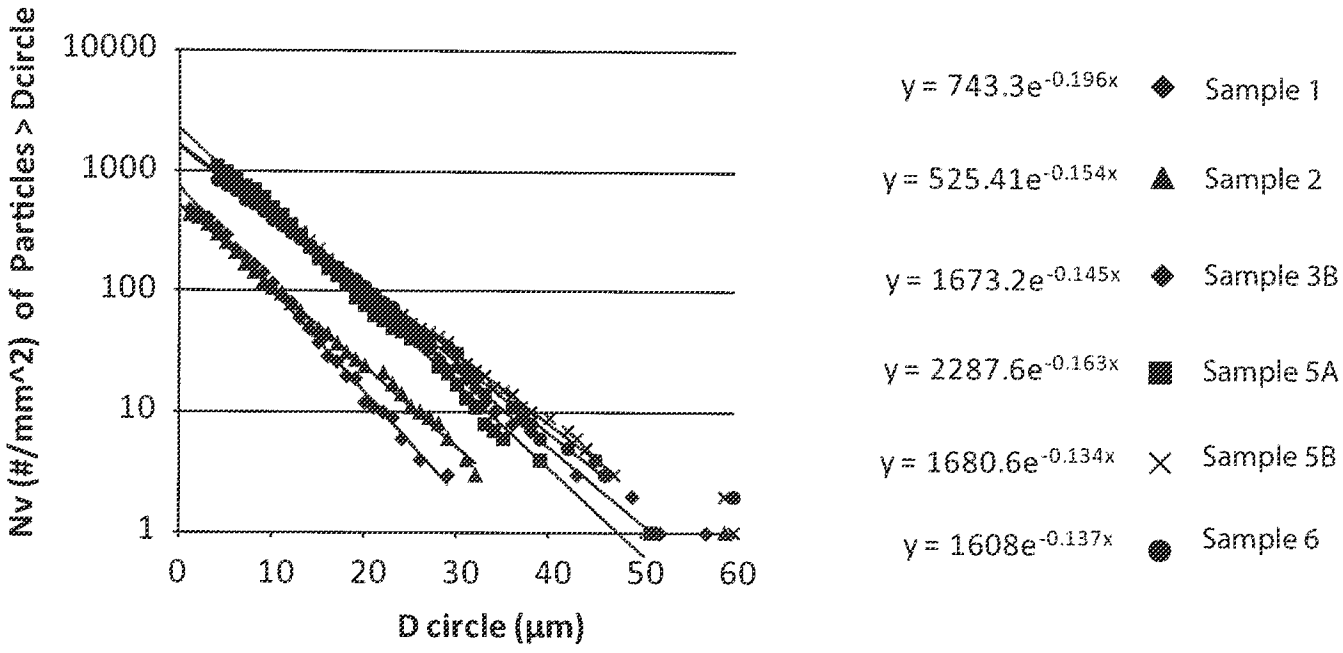
Figure 13B:
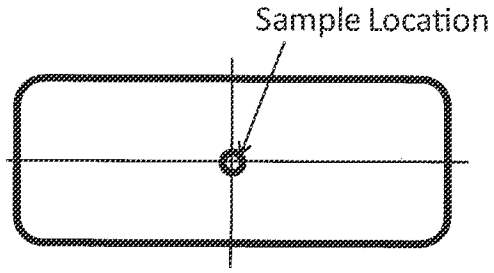

FIG. 13A shows the results for samples taken from the center width and center thickness (CC) position. The CC position is the last liquid metal to solidify. As such it is usually the most concentrated and has more large intermetallics than other positions. It is also the hardest position to affect and the hardest to become recrystallized during rolling. The slopes are shown in Table 5 below.

TABLE 5

| Casting | QC | CQ | QQ | CC |
|---|---|---|---|---|
| Sample 1 | −0.142 | −0.161 | −0.161 | −0.145 |
| Sample 2 | −0.191 | −0.296 | −0.232 | −0.163 |
| Sample 3B | −0.180 | −0.237 | −0.214 | −0.134 |
| Sample 5A | −0.135 | −0.184 | −0.170 | −0.137 |
| Sample 5B | −0.261 | −0.232 | −0.262 | −0.196 |
| Sample 6 | −0.137 | −0.144 | −0.135 | −0.154 |

The slope of the best fit line for these samples is almost always flatter than at the other sample positions. Looking at the data points on the left of the abscissa, it can be seen that there are fewer small particles in this area than in any of the other locations. Fewer small particles and more big ones indicate that the small ones had time to grow while the remainder of the ingot was solidifying. The larger particles may be broken up during rolling, or they may stay large and cause issues for the final product. In either case, large particles will not be of as much help for nucleating new grains as small particles.

That being said, Samples 1 and 2 had exponents of −0.196 and −0.154, respectively. The best ingot involving in-situ homogenization with quench had a slope of −0.163.

Figure 14A:
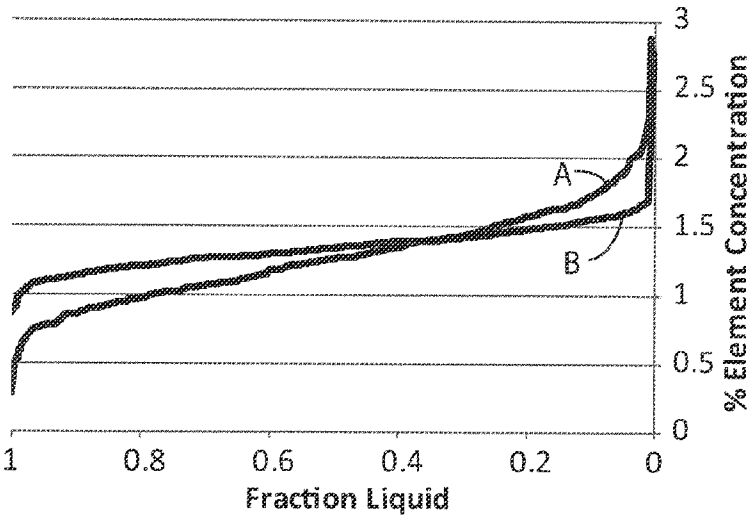
Figure 14B:
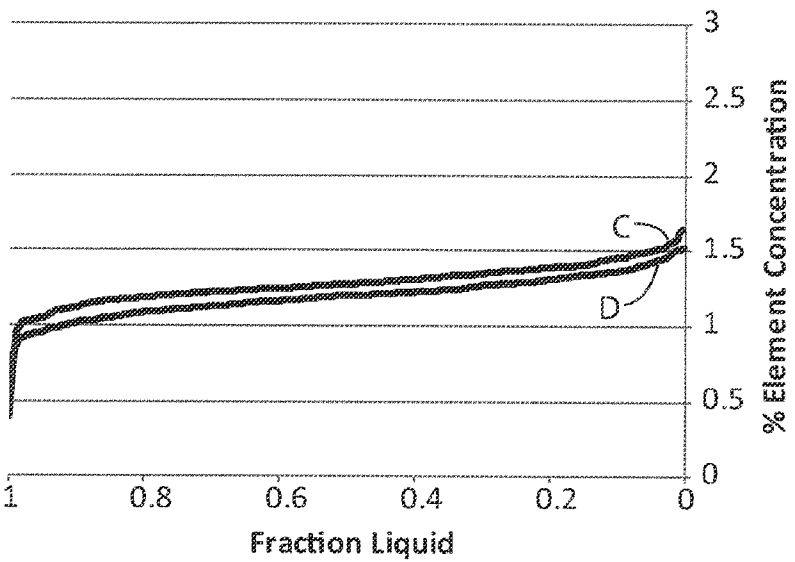

FIGS. 14A and 14B are microsegregation plots comparing percentage element concentrations for samples treated differently. FIG. 14A compares the microsegregation in a normal Direct Chill as-cast structure with an in-situ as-cast sample. The effective partition coefficient is 0.73 for the DC ingot (line A), compared to a theoretical maximum of 0.51. This is the baseline partition coefficient used for comparison to the in-situ case of 0.87 (line B).

FIG. 14B shows a DC sample after a simulated preheat according to the AluNorf preheat cycle of 600° C./500° C. (1112/932° F.) with an effective partition coefficient of 0.89 (line C), much closer to a theoretical equilibrium level of 1.0. The in-situ sample, after a brief heat to roll cycle up to 500° C. (932° F.) (line D), yielded a partition coefficient of 0.90, or basically the same exact degree of microsegregation as the DC cast and preheated sample showed (for a longer time at higher temperature).

Figure 15A:
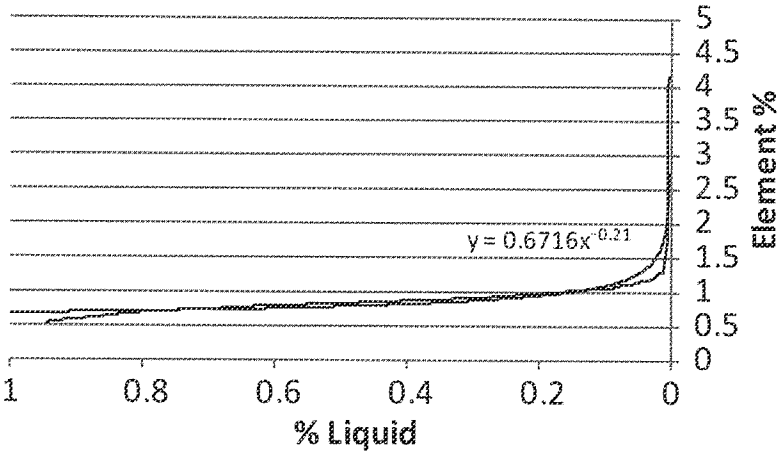
Figure 15B:
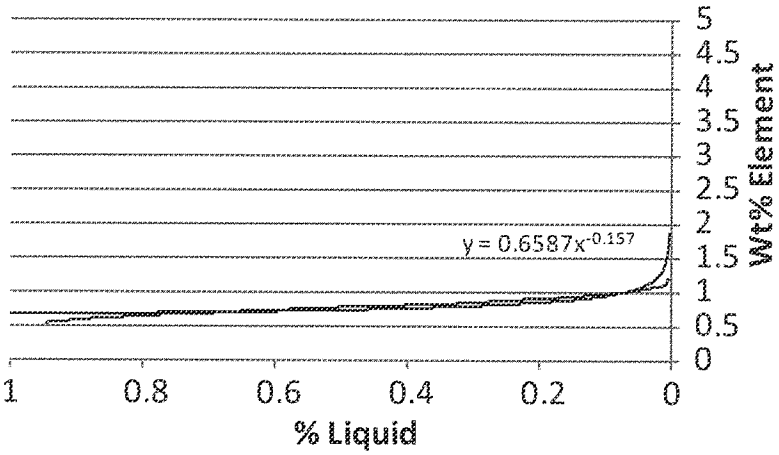

FIGS. 15A and 15B are similar graphs for samples of CC position, or center width and center thickness. Data was not taken at this point for Samples 1 or 2, but it was possible to make a comparison between the Samples 3, 4 and 5. Samples 4 and 5 showed a good improvement over the earlier Sample 3 results, with only minor changes to the in-situ and quench procedure.

Data is shown in Table 6 below.

TABLE 6

| | Sample 2 | Sample 4A | Sample 4B |
|---|---|---|---|
| QC | 0.79 | | 0.82 |
| CQ | 0.78 | 0.83 | 0.85 |
| CC | | 0.79 | 0.84 |

Figure 16C:
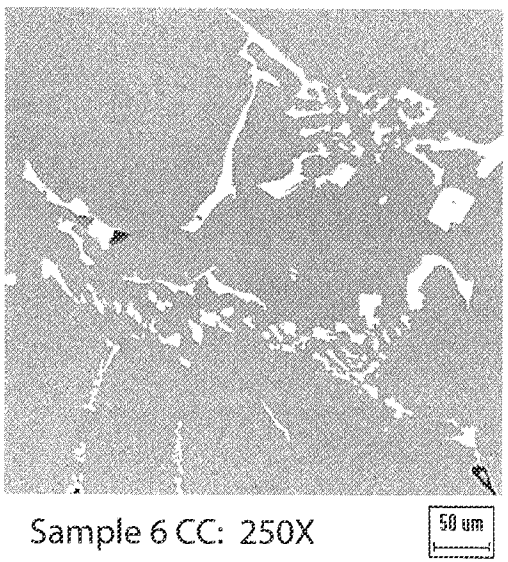
FIGS. 16A, 16B, 16C, 17A, 17B, 17C, 18A, 18B, 18C, 19A, 19B and 19C are photomicrographs of metals cast according to the Examples.
Figure 16B:
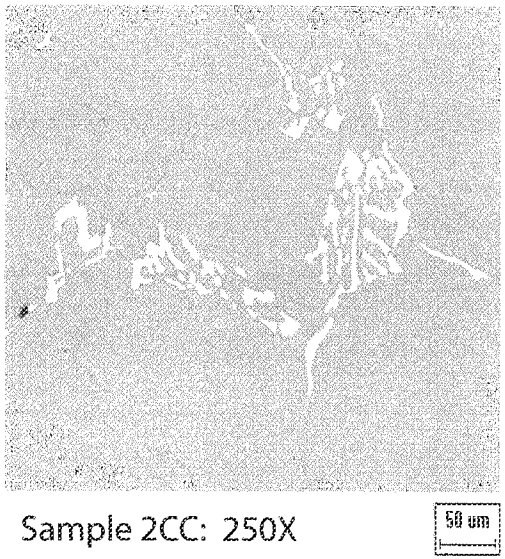
Figure 16A:
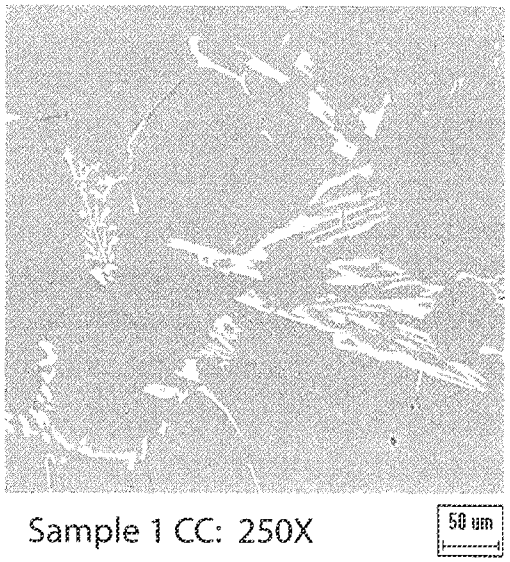
Figure 16D:
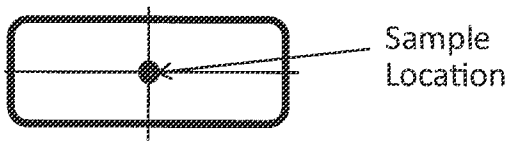
FIGS. 16D, 17D, 18D and 19D are diagrams showing the positions on the ingot where the respective samples for the photomicrographs were obtained.
Figure 17A:
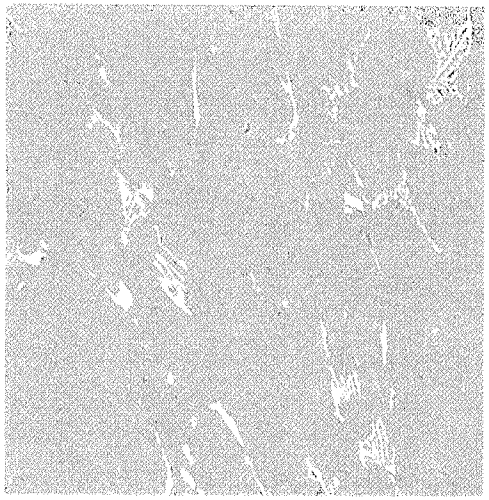
Figure 17B:
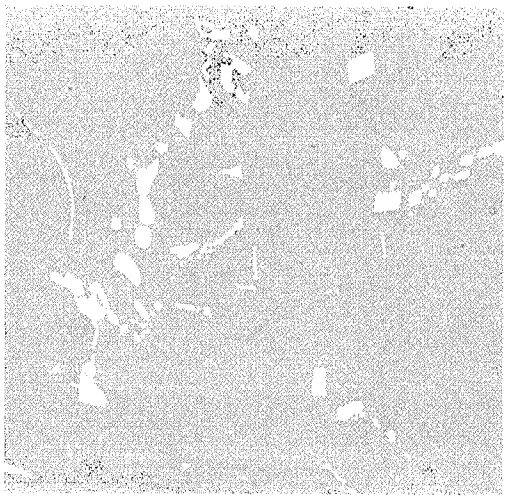
Figure 17C:
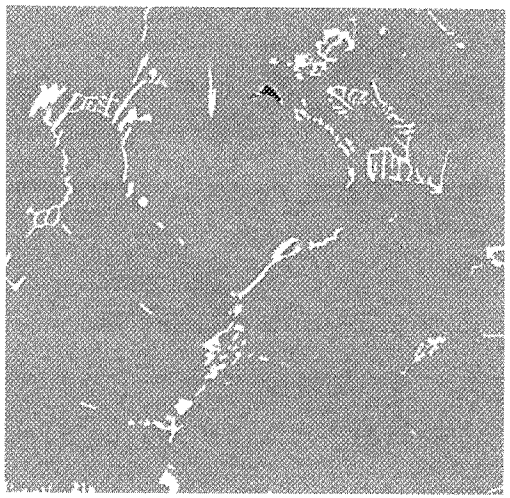
Figure 17D:
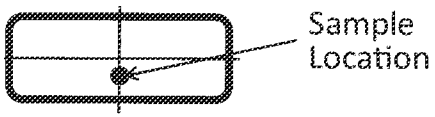
Figure 18A:
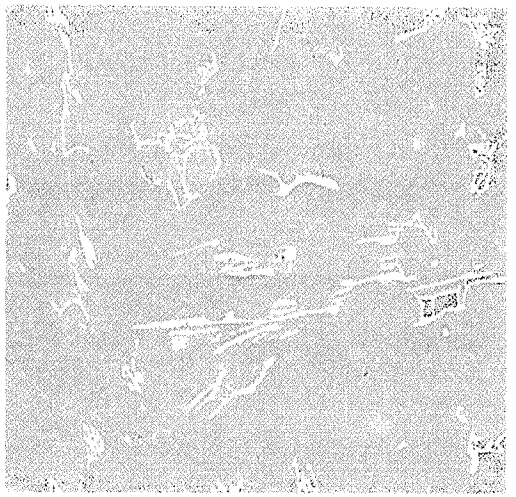
Figure 18B:
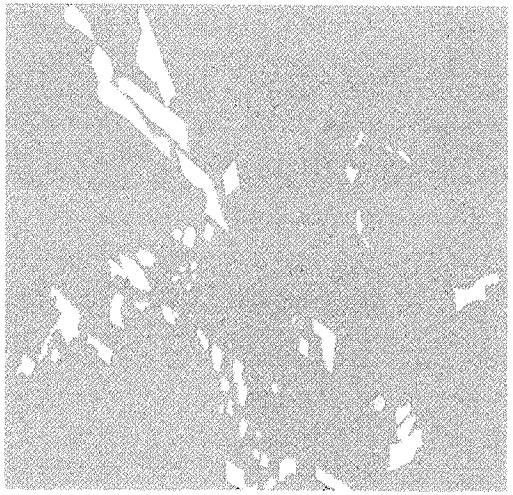
Figure 18C:
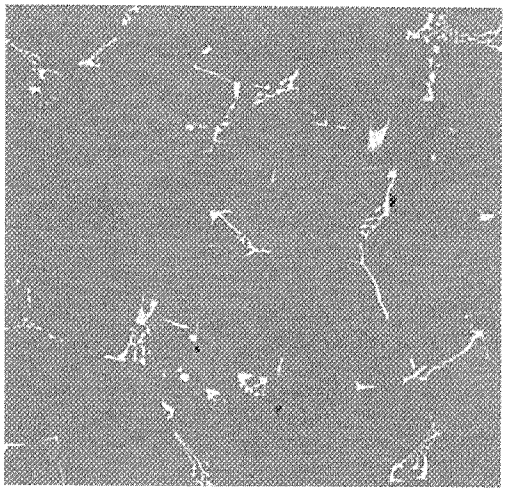
Figure 18D:
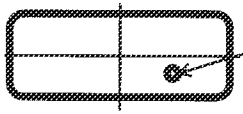
Figure 19A:
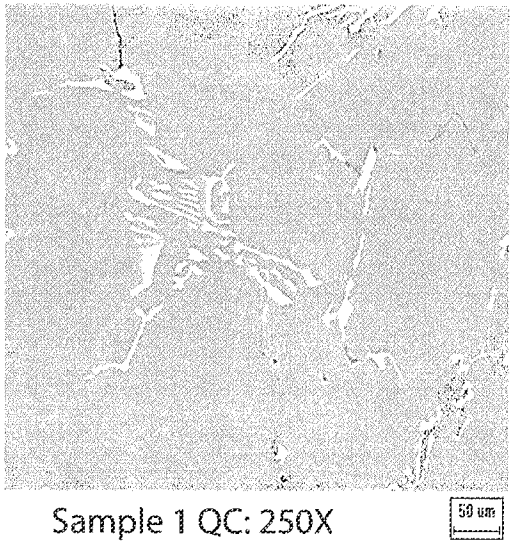
Figure 19B:
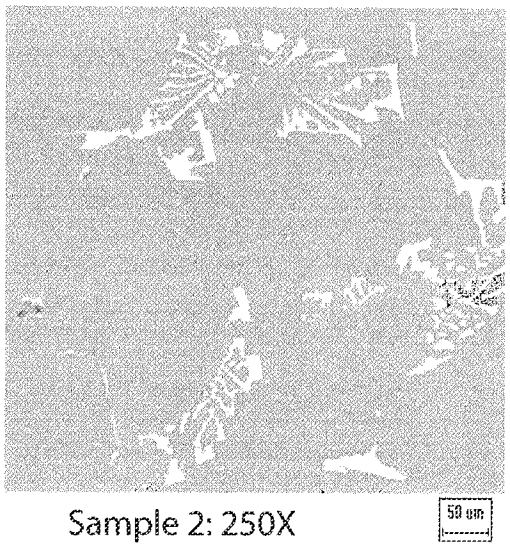
Figure 19C:
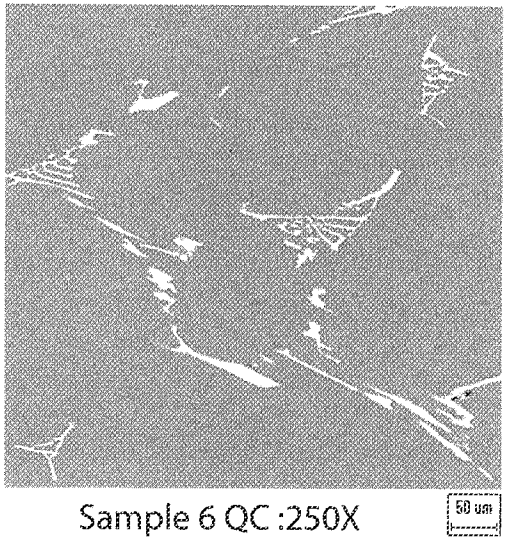
Figure 19D:
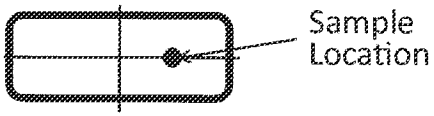

FIGS. 16A, 16B and 16C are micrographs taken at the same magnification from Samples 1, 2 and 6. FIG. 16D shows the position in the ingot from which the samples were taken (the CC position). Similar micrographs are shown in FIGS. 17A, 17B and 17C, and in FIGS. 18A, 18B and 18C, and in FIGS. 19A, 19B and 19C for samples taken, respectively, from the positions shown in FIGS. 17D, 18D and 19D (the CQ, QQ and QC positions, respectively).

These pictures show that the regular in-situ ingot (the figures with a B subscript) tends to have larger coarse constituents than the DC ingot (the figures with the A subscript). The logarithmic graphs earlier showed the ingots produced by in-situ with quench (ISQ) had coarse constituents as large or larger than the direct chill along (DC) or in-situ (IS) ingots. However, the micrographs show that the constituents of the in-situ with quench (ISQ) ingots have a physical shape that makes them likely to break up during rolling, providing additional small coarse constituents for small grains to nucleate upon.

What is claimed is:

1. Apparatus for casting a metal ingot, comprising:

(a) a vertically oriented open-ended direct chill casting mold having a region where molten metal supplied to the mold through a mold inlet is peripherally confined by mold walls, thereby providing molten metal supplied to the mold with a peripheral portion, and a mold outlet receiving a movable bottom block;

(b) a chamber surrounding the mold walls for containing a primary coolant to cool the mold walls and thereby cool the peripheral portion of the molten metal to form an embryonic ingot having an external solid shell and an internal molten core;

(c) a movable support for the bottom block enabling the bottom block to advance away from the mold outlet in a direction of advancement while the molten metal is introduced into the mold through the inlet, thereby enabling the formation of an embryonic ingot having the molten core and solid shell;

(d) jets for directing a supply of a first coolant liquid onto the outer surface of the embryonic ingot;

(e) a wiper for removing the first coolant liquid from the outer surface of the embryonic ingot at a first location along the outer surface of the ingot where a cross section of the ingot perpendicular to the direction of advancement intersects a portion of the molten core; and (f) nozzles operably coupled to the wiper to apply a second coolant liquid to the outer surface of the embryonic ingot at a second location where a cross section of the ingot perpendicular to the direction of advancement intersects a portion of the molten core, the nozzles being adapted to apply the second coolant liquid in an amount less than the first coolant liquid applied by the jets, wherein the nozzles are angled so that the second location is located a distance away from the first location sufficient to allow the outer shell to rebound in temperature by at least 100° C. between the first location and the second location.

2. The apparatus of claim 1, wherein the mold is rectangular for producing a substantially rectangular ingot having wider rolling faces and narrower edge faces.

3. The apparatus of claim 2, wherein said nozzles for applying the second coolant liquid are positioned adjacent to central regions of said wider rolling faces of the ingot emerging from said mold.

4. The apparatus of claim 1, wherein each of said nozzles for applying said second cooling liquid is shaped to project a spray of said second coolant liquid.

5. The apparatus of claim 4, wherein each of said nozzles is adapted to produce said sprays having a shape selected from the group consisting of V-shaped, conical and planar.

6. The apparatus of claim 1, wherein said nozzles for applying said second coolant liquid are adapted to supply said liquid in amounts corresponding to 4 to 20% of amounts of said first coolant liquid supplied by said jets.

7. The apparatus of claim 1, wherein the nozzles are angled such that the distance between the first location and the second location is between approximately 150 mm and approximately 450 mm.

8. The apparatus of claim 1, wherein said mold is shaped and dimensioned to produce rectangular ingots having shorter end faces of at least 400mm in width.

9. The apparatus of claim 1, wherein said wiper comprises heat-resistant elastomeric material shaped to engage and encircle said ingot.

10. The apparatus of claim 1, wherein said wiper comprises a jet of fluid directed to remove said secondary coolant from said ingot.

11. The apparatus of claim 10, wherein said jet of fluid is a jet of liquid.

12. The apparatus of claim 1, wherein said wiper and said nozzles are positioned such that the second location is spaced from said first location along said ingot in said direction of advancement by a distance of approximately 150 to 450 mm.

13. The apparatus of claim 4, wherein at least one of the nozzles is vertically offset from at least one other of the nozzles in the direction of advancement.

14. Apparatus for casting a metal ingot, comprising:

(a) a vertically oriented open-ended direct chill casting mold having a region where molten metal supplied to the mold through a mold inlet is peripherally confined by mold walls, thereby providing molten metal supplied to the mold with a peripheral portion, and a mold outlet receiving a movable bottom block;

(b) a chamber surrounding the mold walls for containing a primary coolant to cool the mold walls and thereby cool the peripheral portion of the molten metal to form an embryonic ingot having an external solid shell and an internal molten core;

(c) a movable support for the bottom block enabling the bottom block to advance away from the mold outlet in a direction of advancement while the molten metal is introduced into the mold through the inlet, thereby enabling the formation of an embryonic ingot having the molten core and solid shell;

(d) jets for directing a supply of a first coolant liquid onto the outer surface of the embryonic ingot;

(e) a wiper for removing the first coolant liquid from the outer surface of the embryonic ingot at a first location along the outer surface of the ingot where a cross section of the ingot perpendicular to the direction of advancement intersects a portion of the molten core; and (f) nozzles operably coupled to the wiper for applying a second coolant liquid to the outer surface of the embryonic ingot at a second location where a cross section of the ingot perpendicular to the direction of advancement intersects a portion of the molten core, the nozzles being adapted to apply the second coolant liquid in an amount less than the first coolant liquid applied by the jets, wherein the nozzles are angled such that the second location is located a distance away from the first location sufficient to allow the outer shell to rebound in temperature by at least 100° C. between the first location and the second location.

15. The apparatus of claim 14, wherein each of said nozzles for applying said second cooling liquid is shaped to project a spray of said second coolant liquid.

16. The apparatus of claim 15, wherein at least one of the nozzles is vertically offset from at least one other of the nozzles in the direction of advancement.

17. The apparatus of claim 15, wherein each of said nozzles is configured to produce the sprays having a V-shape.

18. The apparatus of claim 14, wherein the wiper is movable relative to the jets in the direction of advancement.

19. Apparatus for casting a metal ingot, comprising:

(a) a vertically oriented open-ended direct chill casting mold having a region where molten metal supplied to the mold through a mold inlet is peripherally confined by mold walls, thereby providing molten metal supplied to the mold with a peripheral portion, and a mold outlet receiving a movable bottom block;

(b) a chamber surrounding the mold walls for containing a primary coolant to cool the mold walls and thereby cool the peripheral portion of the molten metal to form an embryonic ingot having an external solid shell and an internal molten core;

(c) a movable support for the bottom block enabling the bottom block to advance away from the mold outlet in a direction of advancement while the molten metal is introduced into the mold through the inlet, thereby enabling the formation of an embryonic ingot having the molten core and solid shell;

(d) jets for directing a supply of a first coolant liquid onto the outer surface of the embryonic ingot;

(e) a wiper for removing the first coolant liquid from the outer surface of the embryonic ingot at a first location along the outer surface of the ingot where a cross section of the ingot perpendicular to the direction of advancement intersects a portion of the molten core; and (f) a plurality of nozzles operably coupled to the wiper and angled to apply a second coolant liquid to the outer surface of the embryonic ingot at a second location where a cross section of the ingot perpendicular to the direction of advancement intersects a portion of the molten core, the plurality of nozzles being adapted to apply the second coolant liquid in an amount less than the first coolant liquid applied by the jets, wherein each of the plurality of nozzles is angled such that the second location is located a distance away from the first location sufficient to allow the outer shell to rebound in temperature by at least 100° C. between the first location and the second location.

20. The apparatus of claim 19, wherein at least some of the plurality of nozzles are vertically offset from at least some of the other of the plurality of nozzles in the direction of advancement.

21. The apparatus of claim 19, wherein each of said nozzles is adapted to produce sprays of said second coolant liquid having a V-shape.

22. The apparatus of claim 19, wherein the wiper is movable relative to the jets in the direction of advancement.

* * * * *